US009024862B2

(12) United States Patent
Rhodes

(10) Patent No.: US 9,024,862 B2
(45) Date of Patent: May 5, 2015

(54) DYNAMIC CREATION OF WAVEFORM PALETTE

(75) Inventor: Bradley J. Rhodes, Alameda, CA (US)

(73) Assignee: Ricoh Co., Ltd., Tokyo (JP)

( * ) Notice: Subject to any disclaimer, the term of this patent is extended or adjusted under 35 U.S.C. 154(b) by 1319 days.

(21) Appl. No.: 12/497,471

(22) Filed: Jul. 2, 2009

(65) Prior Publication Data

US 2011/0001764 A1 Jan. 6, 2011

(51) Int. Cl.
*G09G 3/34* (2006.01)

(52) U.S. Cl.
CPC ..... *G09G 3/344* (2013.01); *G09G 2310/04* (2013.01); *G09G 2380/02* (2013.01)

(58) Field of Classification Search
CPC . G02F 1/167; G02F 2001/1678; G09G 3/344; G09F 9/372; G02B 26/026
USPC ..... 345/107, 600–602; 359/296
See application file for complete search history.

(56) References Cited

U.S. PATENT DOCUMENTS

| | | | | |
|---|---|---|---|---|
| 6,504,524 | B1 | 1/2003 | Gates et al. | |
| 6,531,997 | B1 | 3/2003 | Gates et al. | |
| 7,012,600 | B2 * | 3/2006 | Zehner et al. | 345/214 |
| 7,119,772 | B2 | 10/2006 | Amundson et al. | |
| 2006/0192751 | A1 * | 8/2006 | Miyasaka et al. | 345/107 |
| 2007/0085819 | A1 | 4/2007 | Zhou et al. | |
| 2008/0309612 | A1 * | 12/2008 | Gormish et al. | 345/105 |
| 2008/0309636 | A1 | 12/2008 | Feng et al. | |
| 2008/0309648 | A1 | 12/2008 | Erol et al. | |
| 2008/0309674 | A1 | 12/2008 | Barrus et al. | |
| 2008/0309953 | A1 | 12/2008 | Feng | |
| 2009/0219264 | A1 | 9/2009 | Erol et al. | |

FOREIGN PATENT DOCUMENTS

| | | |
|---|---|---|
| WO | 2005054933 | 6/2005 |
| WO | 2005101362 | 10/2005 |

OTHER PUBLICATIONS

Zehner, R. et al., "Drive Waveforms for Active Matrix Electrophoretic Displays," SID Symposium Digest of Technical Papers, May 2003, pp. 842-845, vol. 34, Issue 1.

* cited by examiner

*Primary Examiner* — Amr Awad
*Assistant Examiner* — Aaron Midkiff
(74) *Attorney, Agent, or Firm* — Patent Law Works LLP.

(57) ABSTRACT

A system and method for driving a display region on the display are described. The method includes receiving a desired color for a pixel, determining a waveform to drive the pixel to desired color, updating frame buffer with an index to the determined waveform, updating waveform table with the determined waveform, and then driving the pixel on the display using the index and associated waveform. After the drive, the waveform is removed from the waveform table and the corresponding pixel in frame buffer is updated with an index corresponding to a null waveform.

20 Claims, 19 Drawing Sheets

DYNAMIC CREATION OF WAVEFORM PALETTE

BACKGROUND OF THE INVENTION

1. Field of Art

The disclosure generally relates to the field of electronic paper displays. More particularly, the invention relates to systems and methods for dynamically creating waveform palettes that include representation of waveforms for driving pixels in a display region.

2. Description of the Related Art

Several technologies have been introduced recently that provide some of the properties of paper in a display that can be electronically driven to display various objects. Some of the desirable properties of paper that this type of display tries to achieve include: low power consumption, flexibility, wide viewing angle, low cost, light weight, high resolution, high contrast and readability indoors and outdoors. Because these types of displays attempt to mimic the characteristics of paper, they are referred to as electronic paper displays (EPDs) in this application. Other names for this type of display include: paper-like displays, zero power displays, e-paper and bi-stable displays.

A comparison of EPDs to Cathode Ray Tube (CRT) displays or Liquid Crystal Displays (LCDs) reveal that in general, EPDs require less power and have higher spatial resolution; but have the disadvantages of slower update rates, less accurate color control and lower color resolution. Many electronic paper displays were previously only grayscale devices. Color EPDs are becoming available although often through the addition of a color filter, which tends to reduce the spatial resolution and the contrast.

The key feature that distinguishes EPDs from LCDs or CRTs is that EPDs can maintain an image without using power. They are sometimes referred to as "bi-stable" because black or white pixels can be displayed continuously and power is only needed to change from one state to another. However, some devices are stable at multiple states and thus support multiple colors without power consumption. EPDs are also typically reflective rather than transmissive. Thus they are able to use ambient light rather than requiring a lighting source in the device. Various technologies have been developed to produce EPDs. Depending on the technology used, such displays are sometimes called electrophoretic displays, electro-wetting displays, or cholesteric LCD (Ch-LC). Techniques have also been developed to produce EPDs by embedding organic transistors into flexible substrates.

The luminance or color of a pixel in a traditional LCD display depends on the voltage currently being applied at the given point, with a given voltage reliably corresponding to a specific luminance. The luminance or color of a pixel in a bistable display, on the other hand, typically changes as voltage is applied. For example, in some bi-stable displays applying a negative voltage to a pixel makes it lighter (higher luminance) and a positive voltage makes it darker. The higher the voltage and the longer or more times that voltage is applied, the larger the change in luminance. This has two implications for driving such displays. First, electronic paper displays are typically controlled by applying a sequence of voltages to a pixel instead of just a single value like a typical LCD. These sequences of voltages are sometimes called waveforms. The second implication is that the control signals used to drive a pixel depend not only on the optical state to which the pixel is being driven, but also on the optical state from which it is being driven. Depending on the display technology, other factors may also need to be taken into consideration when choosing the waveform to drive a pixel to a desired color. Such factors can include the temperature of the display, optical state of the pixel prior to the current optical state and dwell time (i.e. the time since the pixel was last driven). Failure to take these factors into account can lead to faint remnants of images that have supposedly been erased still being visible, a visual artifact known as ghosting. Some displays also have additional requirements that must be met to avoid damaging the display, such as the requirement that waveforms be DC balanced.

To handle these issues, some controllers for driving the EPDs are configured like an indexed color-mapped display. The frame buffer of these EPDs includes an index to the waveform used to drive that pixel instead of the waveform itself. Whenever the optical state of a pixel is to be changed, the index of the appropriate waveform is chosen based on at least some of the factors listed above, and the pixel's location or the frame buffer pixel in the frame buffer is set to that index. Some displays encode some factors (such as a pixel's current and desired optical state) in the waveform index and then choose which waveform table to drive a set of pixels based on other factors (such as temperature).

A drawback of the approach used by these controllers is that while waveforms for a first update are being applied to the display, these controllers cannot apply a second update specified by an end user application. These controllers must wait until the first update is completed before starting a second update. This introduces unacceptable latencies in changing pixel values for rendering.

SUMMARY OF THE INVENTION

The present invention includes a system and method for updating a display region on the display. The system comprises a frame buffer, a waveform table, a current palette, a palette controller, a waveform determination module, a waveform library, a frame buffer controller, a palette transfer module, an expiration module, a display controller and a display.

The palette controller receives the desired color for a display pixel in the display region. The palette controller requests a waveform to drive the display pixel to desired color from the waveform determination module. The waveform determination module either retrieves the waveform from a waveform library or computes the waveform and transmits the waveform to palette controller. The palette controller then associates an index with the received waveform and copies the index and the waveform to a current palette. The frame buffer controller then updates the frame buffer pixel in frame buffer corresponding to the display pixel. The frame buffer controller populates the frame buffer pixel with an index associated with the determined waveform.

The palette controller and frame buffer controller repeat the above mentioned process for additional display pixels in the display region. After the current palette and frame buffer has been updated for the additional pixels, the palette transfer module transfers the waveforms from the current palette to the waveform table. The display controller then reads the indices from frame buffer pixels in frame buffer, reads the corresponding waveforms from waveform table, applies the waveforms to display pixels and drives the display pixels to the desired colors.

After the display controller has driven the display pixels to the desired colors for the display region, the expiration module updates the waveform table and the frame buffer to remove the waveforms and associated indices for the completed update.

BRIEF DESCRIPTION OF THE DRAWINGS

The file of this patent or application contains at least one drawing executed in color. Copies of this patent or patent application publication with color drawings will be provided by the USPTO upon request and payment of the necessary fee. The disclosed embodiments have other advantages and features which will be more readily apparent from the detailed description, the appended claims, and the accompanying figures (or drawings).

Figure 1:
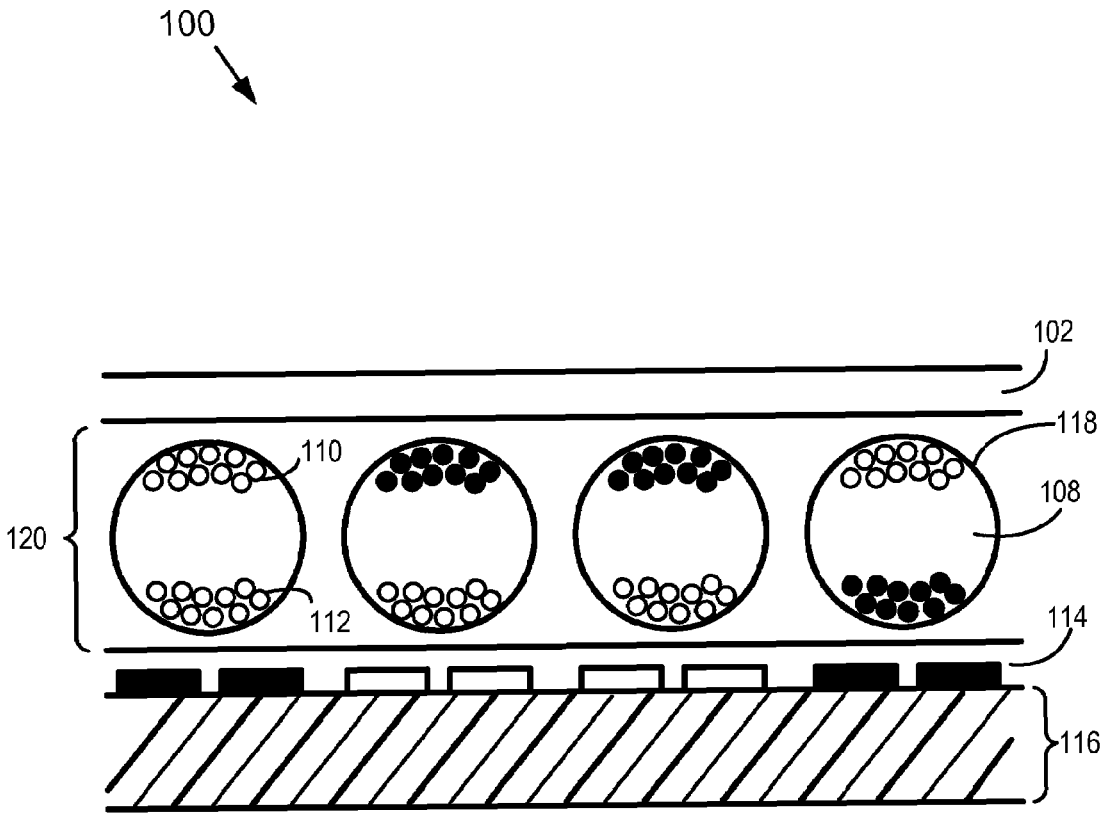
FIG. 1 illustrates a cross-sectional view of a portion of an exemplary electronic paper display.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

A system and method for dynamically creating waveform palettes that includes representation of waveforms for driving pixels in a display region are described. The figures (Figs.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

As used herein any reference to "one embodiment," "an embodiment," or "some embodiments" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct physical or electrical contact with each other, but yet still co-operate or interact with each other. The embodiments are not limited in this context.

Also, some embodiments of the invention may be further divided into logical modules. One of ordinary skill in the art will understand that these modules can be implemented in hardware, firmware and/or software. In one embodiment, the modules are implemented in form of computer instructions stored in a computer readable medium when executed by a processor cause the processor to implement the functionality of the module. Additionally, one of ordinary skill in the art will recognize that a computer or another machine with instructions to implement the functionality of one or more logical modules is not a general purpose computer. Instead, the machine is adapted to implement the functionality of a particular module. Moreover, the machine embodiment of the invention physically transforms the electrons representing the images in the document from one state to another in order to attain the desired format.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Device Overview

FIG. (Fig.) 1 illustrates a cross-sectional view of a portion of an exemplary electronic paper display 100. The components of the electronic paper display 100 are sandwiched between a top transparent electrode 102 and a bottom backplane 116. The top transparent electrode 102 is a thin layer of transparent material. The top transparent electrode 102 allows for viewing of microcapsules 118 of the electronic paper display 100.

Directly beneath the top transparent electrode 102 is the microcapsule layer 120. In one embodiment, the microcapsule layer 120 includes closely packed microcapsules 118 having a clear fluid 108 and some black particles 112 and white particles 110. In some embodiments, the microcapsule 118 includes positively charged white particles 110 and negatively charged black particles 112. In other embodiments, the microcapsule 118 includes positively charged black particles 112 and negatively charged white particles 110. In yet other embodiments, the microcapsule 118 include colored particles of one polarity and different colored particles of the opposite polarity. In some embodiments, the top transparent electrode 102 includes a transparent conductive material such as indium tin oxide.

Disposed below the microcapsule layer 120 is a lower electrode layer 114. The lower electrode layer 114 is a network of electrodes used to drive the microcapsules 118 to a next optical state. The network of electrodes is connected to display circuitry, which turns the electronic paper display "on" and "off" at specific pixels by applying a voltage to specific electrodes. Applying a negative charge to the electrode repels the negatively charged particles 112 to the top of microcapsule 118, forcing the positively charged white particles 110 to the bottom and giving the pixel a black appearance. Reversing the voltage has the opposite effect—the positively charged white particles 112 are forced to the surface, giving the pixel a white appearance. The luminance of a pixel in an EPD changes as voltage is applied. The amount the pixel's luminance changes may depend on both the amount of voltage and the length of time for which it is applied, with zero voltage leaving the pixel's luminance unchanged.

The electrophoretic microcapsules of the layer 120 may be individually or collectively activated to a next optical state, such as black, white or gray. In some embodiments, the next optical state may be any other prescribed color. Each pixel in layer 114 may be associated with one or more microcapsules 118 contained within a microcapsule layer 120. Each microcapsule 118 includes a plurality of tiny particles 110 and 112 that are suspended in a clear fluid 108. In some embodiments, the plurality of tiny particles 110 and 112 are suspended in a clear liquid polymer.

The lower electrode layer 114 is disposed on top of a backplane 116. In one embodiment, the electrode layer 114 is integral with the backplane layer 116. The backplane 116 is a plastic or ceramic backing layer. In other embodiments, the backplane 116 is a metal or glass backing layer. The electrode layer 114 includes an array of addressable pixel electrodes and supporting electronics.

Figure 2A:
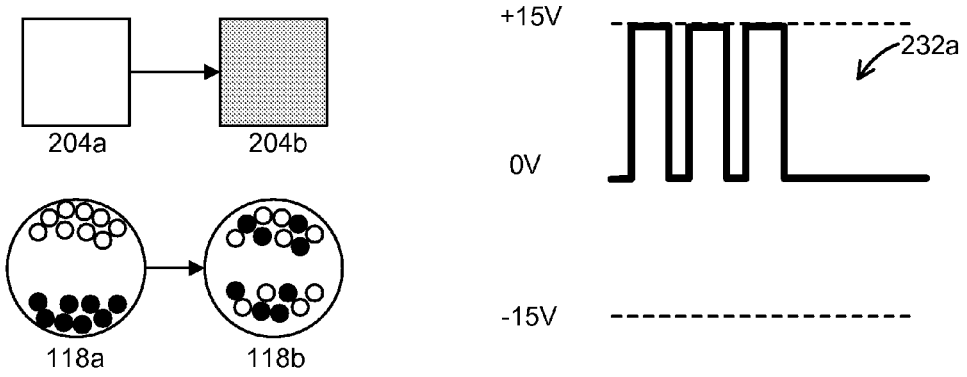
FIGS. 2A-2C are functional diagrams that illustrate the movement of white particles and black particles in a microcapsule of electronic paper display in response to applied waveform leading to change in color of a corresponding pixel.
Figure 2B:
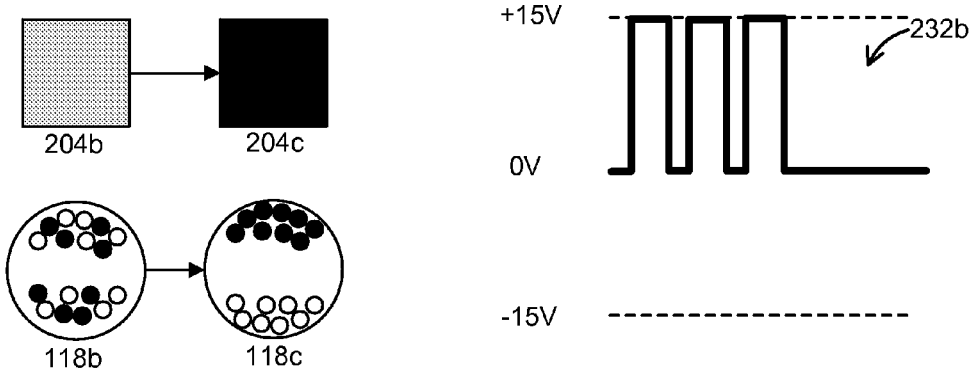
Figure 2C:
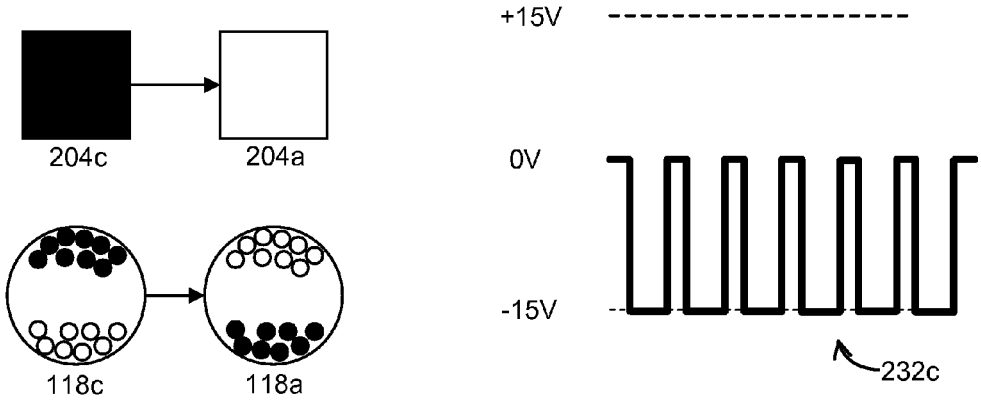

FIGS. 2A-2C illustrate the movement of white particles 110 and black particles 112 in microcapsule 118 of electronic paper display in response to the applied waveform leading to changes in color of a corresponding pixel. For clarity and ease of understanding, FIGS. 2A-2C do not display every physical layer of electronic paper display 100. FIGS. 2A-2C instead display examples of waveforms 232*a-c* that can be applied by electrode layer 114 to one or more microcapsules 118 and the resulting change in pixel color 204*a-c*.

FIG. 2A illustrates a change in position of white particles 110 and black particles 112 in microcapsule 118 when electrode layer 114 applies a waveform 232*a* including three frames of +15V. The application of such a waveform 232*a* leads to some of the positively charged black particles 112 to move away from the electrode layer 114 and closer to top transparent electrode 102. For similar reason, some of the negatively charged white particles 110 move towards the positively charged electrode layer 114 and away from the top transparent electrode 102. This movement of black and white particles 112, 110 leads to a mixture of black and white particles 112, 110 visible through the top transparent electrode 102. The visible mixture appears as a gray color 204*b* for a corresponding pixel. As discussed above, microcapsule 118 maintains this state or this gray color 204*b* until another waveform is applied to the microcapsule 118.

FIG. 2B illustrates electrode layer 114 applying another waveform 232*b* to microcapsule 118 after the microcapsule 118 has reached the gray color 204*b*. In this illustration, application of an additional waveform 232*b* including three frames of +15V to microcapsule 118 leads to the remaining negatively charged white particles to move towards the electrode layer 114 and the remaining positively charged black particles to move towards the transparent electrode 102. As a result, all the positively charged black particles are visible through the transparent electrode 102 and the pixel color changes from gray 204*b* to black 204*c*.

FIG. 2C illustrates an application of waveform 232*c* including six −15V frames to move all the positively charged black particles 112 close to electrode layer 114 and negatively charged white particles 110 close to transparent electrode 102. As a result, the visible color of the corresponding pixel changes from black 204*c* to white 204*a*.

As apparent from FIG. 2A-2C, six +15V frames change the pixel color from white 204*a* to black 204*c* and six −15V frames change the pixel color from black 204*c* to white 204*a*. In some embodiments, the waveform required to change the color from a first color to a second color may not be exact polar opposite of the waveform required to change the color from the second color back to the first color. In addition, waveforms may contain a mix of positive, negative, or zero voltages.

System Overview

Figure 3A:
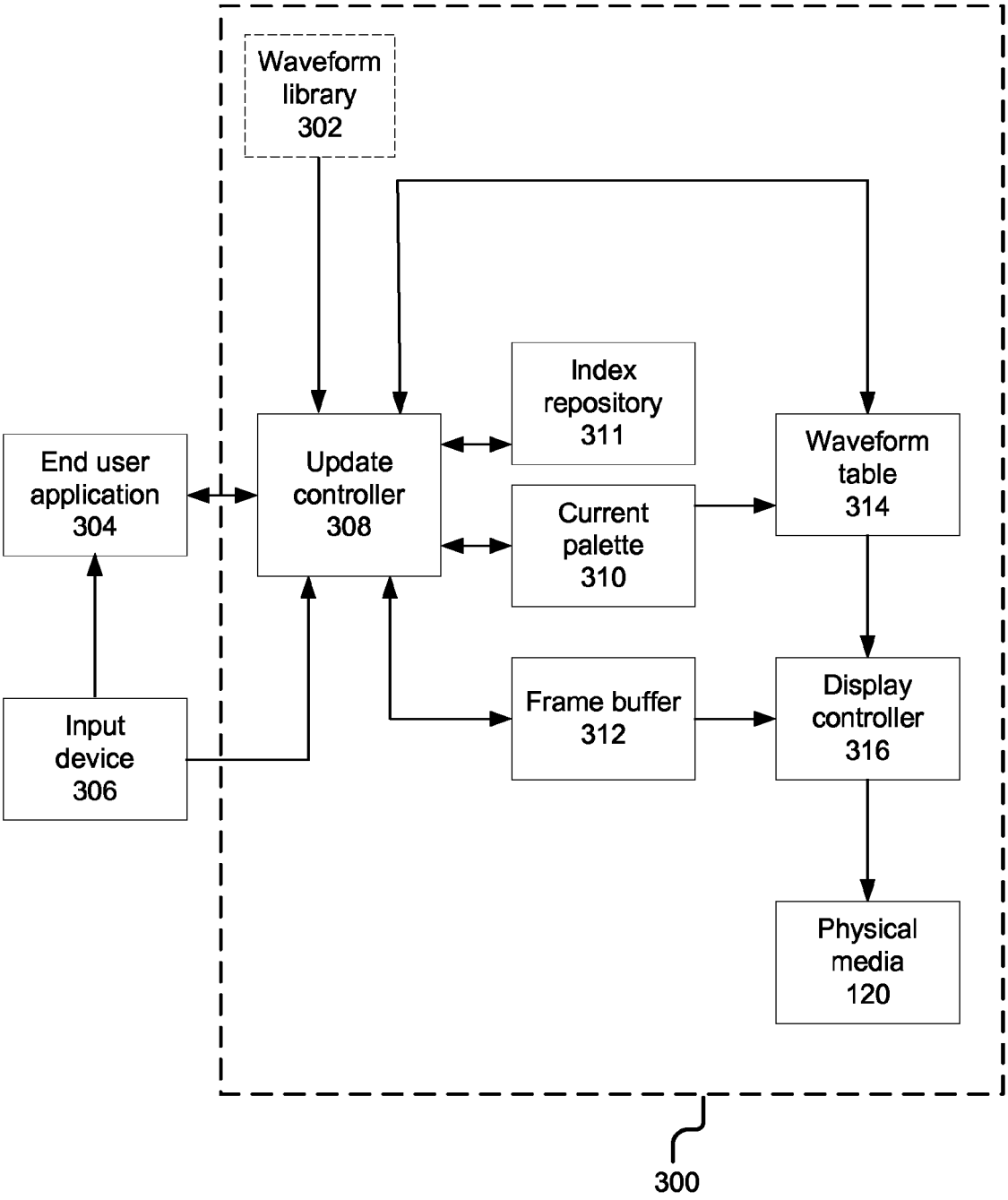
FIG. 3A is a block diagram that illustrates an end user application, an input device and a first embodiment of display system according to the present invention.

FIG. 3A illustrates an end user application 304, an input device 306, and a first embodiment of display system 300 according to a first embodiment of the invention. The end user application 304 and input device 306 are communicatively coupled to each other and the display system 300.

The end user application 304 is an application accessed by a user to display various objects on physical media 120 of the display system 300. Examples of end user application 304 are word processing applications, image editing applications, etc. The end user application 304 communicates with an update controller 308 of the display system 300 and signals the update controller 308 to display various images on physical media 120 as required.

The input device 306 is a device that enables a user to communicate with the end user application 308 and display system 300. Examples of input device 306 include a mouse-type controller, a keyboard, a stylus etc. The input device 306 transmits user input to the end user application 304 and update controller 308. For example, a keyboard 306 can transmit characters to be displayed in a word processing application 308 or a stylus 306 can transmit pen strokes to be displayed in an image editor application 308.

The display system 300 displays various objects in response to signals from the end user application 304 and the input device 306. In a first embodiment, the display system 300 comprises the update controller 308, an index repository 311, a current palette 310, a frame buffer 312, a waveform table 314, a display controller 316, a physical media 120 and optionally a waveform library 302.

The update controller 308 is a computing device that receives signals from the end user application 304 and/or the input device 306, either retrieves or calculates the waveform required to drive one or more pixels on the physical media 120 in response to received signal, retrieves and associates an index with the retrieved waveform, stores the associated index in appropriate frame buffer pixel of frame buffer 312, and stores the retrieved waveform in waveform table 314. In another embodiment, the update controller 308 is a routine executed by a processor for executing the above mentioned functions. The update controller 308 is communicatively coupled to end user application 304, input device 306, index repository 311, current palette 310, frame buffer 312 and optionally coupled to waveform library 302. The update controller 308 is described in more detail with reference to FIG. 4.

The index repository 311 is a storage comprising a collection of available indices. The index repository 311 is any structure that holds a collection of indices. For example, in various embodiments, the index repository 311 is a stack, a queue, a list, etc. formed in memory or some other computer readable medium. The index repository 311 is communicatively coupled to update controller 308 to provide indices in response to a signal requesting an index. The update controller 308 uses available indices from the index repository 311 to index waveforms required to drive display pixels to their desired colors. After driving the display pixels to their desired colors, the update controller 308 returns the indices to index repository 311 and the index repository 311 adds the indices to the collection of available indices so they are available again for a different set of waveforms.

The current palette 310 is a storage capable of storing a collection of indices and associated waveforms for driving one or more pixels in a region of physical media 120. The current palette 310 is communicatively coupled to the waveform table 314 and the update controller 308. The update controller 308 stores waveforms for driving one or more pixels in a region of physical media 120 in the current palette 310. The update controller 310 uses the information stored in the current palette 310 to update the corresponding region of frame buffer 312 with associated indices and to copy the waveforms and associated indices from current palette 310 to waveform table 314 and committed palette list 416 (described in FIG. 4). The update controller 308 can reuse an index and its associated waveform in the current palette 310 for updating multiple frame buffer pixels in frame buffer 312 if all of those frame buffer pixels require the same waveform to be driven to their respective desired colors. After the waveform and associated indices are copied, the current palette 310 is used to store the next set of waveforms and associated indices for another update region.

Frame buffer 312 is a storage including frame buffer pixels that correspond to pixels on physical media 120. The frame buffer 312 is communicatively coupled to update controller 304 and display controller 316. The update controller 308 updates various frame buffer pixels of frame buffer 312 with indices to waveforms required for driving the display pixels on physical media 120 to their desired color. The display controller 316 reads the frame buffer 312 to determine the index for a frame buffer pixel, and the display controller 316 uses this index to determine the associated waveform from waveform table 314. The determined waveform is applied to the corresponding display pixel on physical media 120 to drive the display pixel to its desired color.

Waveform table 314 is an indexed storage for waveforms that are required to drive the display pixels on physical media 120 to their desired colors. In one embodiment, the waveform table 314 is divided into a plurality of time periods represented by frames and a cycle of waveform table 314 comprises frames from first frame to last frame in waveform table 314. A frame includes a part of the waveform required to drive the display pixel to a desired color. In one embodiment, the waveform table 314 includes a current frame and a cycle number. The current frame is the frame in the waveform table 314 that is being currently read by display controller 316. Similarly, the current cycle is the current cycle being read by the display controller 316. After the display controller 316 has read a complete cycle, the display controller 316 starts reading the next cycle. In other words, the display controller 316 starts reading the waveform table 314 from the first frame again.

The indices in waveform table 314 are not permanently committed to a particular waveform and the indices are updated repeatedly with different waveforms required to drive the display pixels of a region in physical media 120 to a desired color. After the waveforms stored in waveform table 314 have been used to drive the display pixels, those waveforms are removed from the waveform table 314 and their indices are later updated with waveforms required to drive display pixels in another region of physical media 120. Indices that are not populated with a waveform in the waveform table 314 are assumed to correspond to a waveform consisting entirely of zeros, i.e. a waveform that specifies no change to a pixel during any frame. The waveform table 314 is communicatively coupled to display controller 316, current palette 310 and update controller 308. The indices and waveforms are readable by the display controller 316 via the coupling. The waveform table 314 identifies for the update controller 308 via the coupling the current frame being read by the display controller 316. The update controller 308 copies the waveforms from current palette 310 to corresponding indices in one or more frames following the currently read frame in the waveform table 314.

The display controller 316 is a computing device for generating output signals to control the display of images on the physical media 120. In particular, the display controller 316 retrieves the index from frame buffer 312 for a particular display pixel, retrieves the waveform corresponding to the retrieved index from waveform table 314 and applies the waveform to physical media 120 to drive the display pixel on physical media 120 to a desired color. The display controller 316 leaves a pixel unchanged (i.e. it applies zero voltage) if the pixel's corresponding entry in the frame buffer 312 contains an index that is not currently populated with a waveform in the waveform table 314.

The waveform library 302 is an optional (as indicated by the dashed lines) storage that includes various pre-determined waveforms to drive a display pixel from one color to another color. The waveform library 302 is communicatively coupled to the update controller 308 to provide these waveforms. The update controller 308, as described below, retrieves waveforms from the waveform library 302 that are later used to drive the display pixel on physical media 120 to a desired color. In one embodiment, the waveform library 302 includes various pre-determined waveforms to drive a display pixel from one color to another. Accordingly, the waveform used to drive the color depends on the desired purpose. For example, one waveform can be used to reduce displayed artifacts while another waveform can be used to quickly drive the display pixel to a desired color. In one embodiment, different waveforms may be chosen depending on other factors such as dwell time or current temperature. Furthermore, in one embodiment, the waveforms are specific to the physical media 120 and the display controller 316.

The physical media 120 is the microcapsule layer 120 and has been explained above in reference to FIG. 1.

Figure 3B:
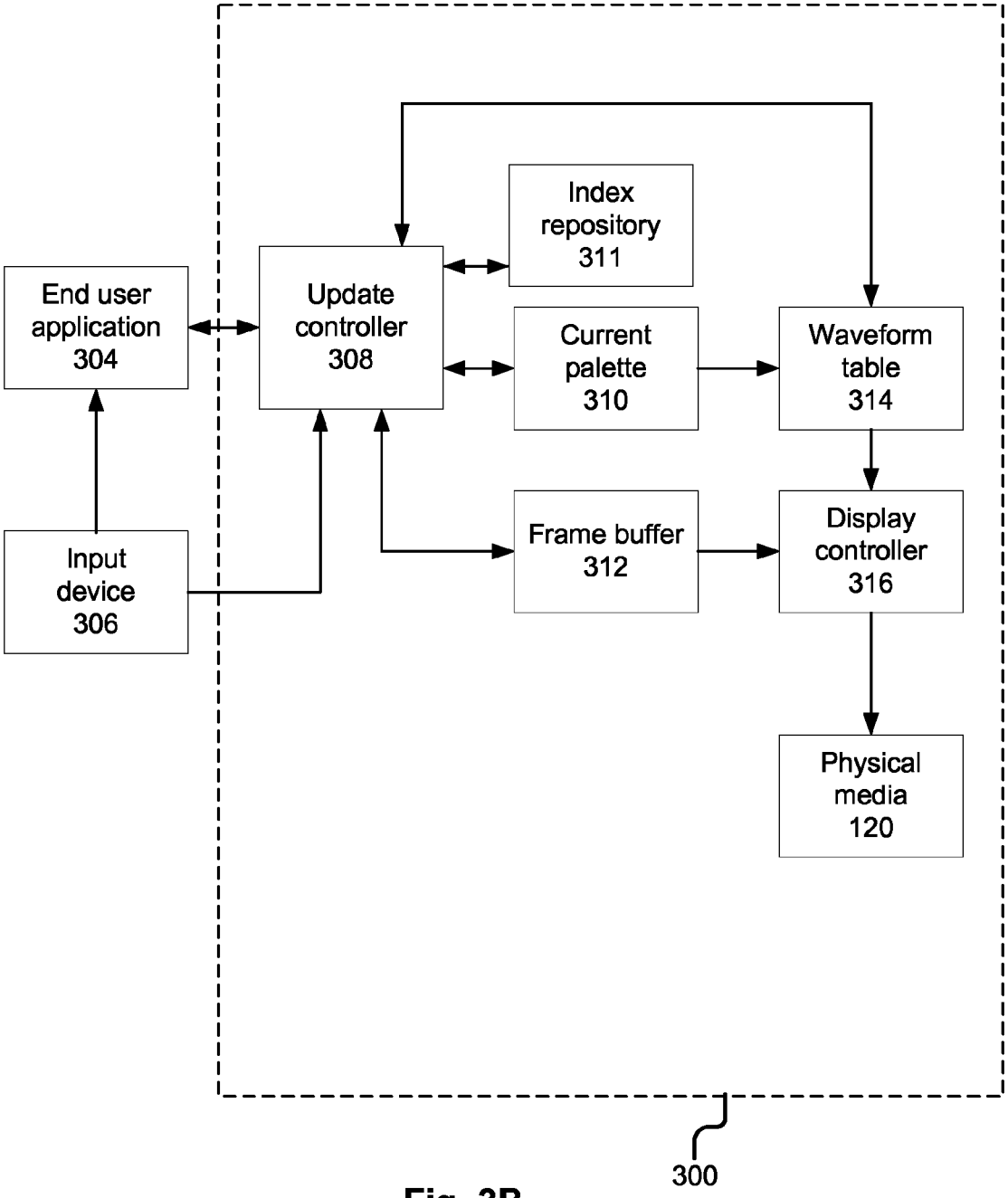
FIG. 3B is a block diagram that illustrates an end user application, the input device and a second embodiment of the display system according to the present invention.

FIG. 3B illustrates an end user application 304, an input device 306, and a second embodiment of display system 300 according to some embodiments of the invention. This embodiment of display system 300 does not include the optional waveform library 302 as included in display system 300 of FIG. 3A. In this embodiment, the update controller 308 computes or constructs the waveform required to drive the pixel instead of retrieving the waveform from waveform library 302. The update controller 308 is described below in FIG. 4.

Update Controller

Figure 4:
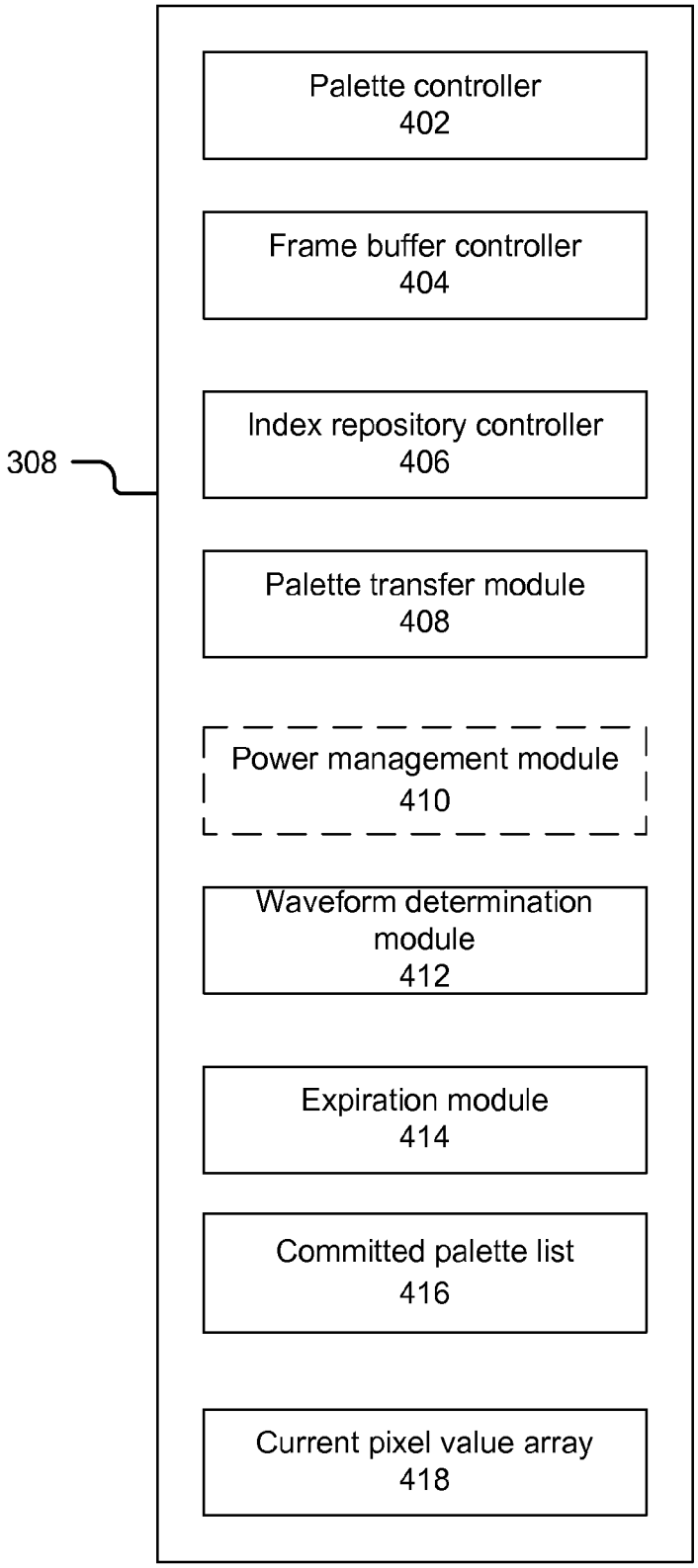
FIG. 4 illustrates a block diagram of an update controller of display system according to an embodiment of the present invention.

FIG. 4 illustrates the update controller 308 in detail according to an embodiment of the invention. The update controller 308 comprises a palette controller 402, a frame buffer controller 404, an index repository controller 406, a palette transfer module 408, a power management module 410, a waveform determination module 412, an expiration module 414, a committed palette list 416, and a current pixel value array 418.

The palette controller 402 is a computing device for populating the current palette 310 with waveforms and associated indices for updating a display region. The palette controller 402 also updates the current colors for pixels in current pixel value array 418. In another embodiment, the palette controller 402 is a routine executed by a processor for executing the functions of palette controller 402. The palette controller 402 is communicatively coupled to the end user application 304, waveform determination module 412, index repository controller 406, current palette 310, palette transfer module 408, frame buffer controller 404 and expiration module 414. The palette controller 402 receives from end user application 304 a signal specifying the display update region of physical media 120 that is to be driven. The palette controller 402 also receives from the end user application 304 the desired colors for the display pixels in the display update region. For each display pixel in the display update region, the palette controller 402 queries and receives the required waveform to drive the display pixel, retrieves index from index repository controller 406 for the received waveform, stores the waveform and its associated index in current palette 310, signals the frame buffer controller 404 to update the corresponding frame buffer pixel in the frame update region of frame buffer 312 with associated index, and updates the corresponding pixel in current pixel value array 418.

In one embodiment, the palette controller 402 first determines if the required waveform is already present with its associated index in the current palette 310. If so, the palette controller 402 does not update the current palette 310 with that waveform and the already present waveform and index are reused for updating the corresponding frame buffer pixel.

After the palette controller 402 has updated the current palette 310 with the waveforms and associated indices for the display update region, the palette controller 402 signals the palette transfer module 408 that the current palette 310 is complete and ready to be copied to waveform table 314. In one embodiment, the palette controller 402 waits for a signal from the end user application 304 before signaling the palette transfer module 408.

Eventually, the display pixels in display update region are driven to desired colors, the palette controller 402 receives a signal from expiration module 414 and clears entries in waveform table 314 corresponding to indices associated with the display update region.

The frame buffer controller 404 is a computing device that updates the frame buffer 312. In another embodiment, the frame buffer controller 404 is a routine executed by a processor for executing the functions of frame buffer controller 404. The frame buffer controller 404 is communicatively coupled to palette controller 402, frame buffer 312, expiration module 414 and palette transfer module 408. The frame buffer controller 404 receives from the palette controller 402 the associated index and updates the corresponding frame buffer pixel with the index after receiving the update signal from palette controller 402. After the display pixels in display update region are driven to desired colors, the frame buffer controller 404 receives a signal from expiration module 414 during the expiration method described in FIG. 8 below. Responsive to receiving the signal, frame buffer controller 404 stabilizes pixels from the update region in frame buffer 312 to indices that do not correspond to a waveform (e.g. an index of 00).

The frame buffer controller 402 tracks the update frame buffer pixels and provides a representation of the updated frame region to palette transfer module 408. The frame region can be represented in numerous ways. For example, the frame region can be represented as one or more rectangular bounding boxes, conic sections, or polygons enclosing the updated frame region.

The index repository controller 406 is a computing device that manages the indices in the index repository 311. In another embodiment, the index repository controller 406 is a routine executed by a processor for executing the functions of the index repository controller 406. The index repository controller 406 is communicatively coupled to the palette controller 402 and index repository 311. The index repository controller 406 receives requests for indices from palette controller 402, retrieves indices from index repository 311 and returns the available indices to palette controller 402. If no indices are available in the index repository 311, the index repository controller 406 waits until indices are available and then returns the requested indices to palette controller 406.

The palette transfer module 408 is a computing device that transfers the contents of the current palette 310 to waveform table 314. In another embodiment, the palette transfer module 408 is a routine executed by a processor for executing the functions of the palette transfer module 408. The palette transfer module 408 is communicatively coupled to frame buffer controller 404, waveform table 314, current palette 310 and committed palette list 416. The palette transfer module 408 receives the signal from palette controller 402 indicating that the current palette 310 is complete. The palette transfer module 408 then queries waveform table 314 and determines the current cycle and current frame in waveform table 314 that is being read by display controller 316. The palette transfer module 408 next updates the waveform table 314 with waveforms from the current palette 310 at indices in waveform table 314 corresponding to indices associated with waveforms in current palette 310. The palette transfer module 408 updates the waveform table 314 from one or more frames starting at the frame following the current frame in waveform table 314.

When the current frame number in waveform table 314 is towards the end of the waveform table 314, the waveforms from current palette 310 may not completely fit between the current frame and last frame of waveform table 314. In such cases, the palette transfer module 408 writes part of the waveforms from current palette 310 after the current frame to end of the waveform table 314 and the remaining part of the waveforms to the beginning of waveform table 314. The display controller 316 in such cases drives the pixels in corresponding display region on physical media 120 in two cycles. The update for the region starts with part of the waveforms included at the end of a cycle and ends with part of the waveforms included at the beginning of the new cycle.

The palette transfer module 408 also updates the committed palette list 416 with contents of the current palette 310, a representation of the corresponding frame region, frame number and cycle number of waveform table 314 at which the waveforms from current palette 310 expire. The committed palette list 416 is described in detail below. The palette transfer module 408 computes the expiration cycle number and frame number for the waveforms in current palette 310 by calculating the length of the longest waveform in current palette 310 and adding that length to the cycle number and frame number of the frame next to the current frame of the waveform table 314. The representation of corresponding frame region is provided to the palette transfer module 408 by frame buffer controller 404.

The power management module 410 is an optional (as indicated by dashed lines) computing device that signals the modules in update controller 308 to sleep during certain time intervals in order to conserve battery life. In one embodiment, the power management module 410 is a routine executed by a processor for executing the functions of the power management module 410. The power management module 410 is communicatively coupled to end user application 304 and other modules of update controller 308 like palette controller 402, frame buffer controller 404, index repository controller 406, palette transfer module 408, waveform determination module 412, expiration module 414, committed palette list 416, and current pixel value array 418.

In one embodiment, the power management module 410 instructs other modules in update controller 308 to sleep until instructed otherwise. The end user application 304 writes the signals for updating the physical media 120 into a display buffer. After the end user application 304 has collected a pre-determined amount of signals in the display buffer, the end user application 304 transmits the content of display buffer to power management module 410. The power management module 410 then wakes up the modules in update controller 308 and transmits the received content to palette controller 402. In this manner, the power management module 410 reduces energy consumption by avoiding constant polling of end user application 304 for signals to drive the pixels on display. The power management module 410 instead wakes up the palette controller 402 and other modules in update controller 308 after receiving a pre-determined amount of signals to be displayed on physical media 120.

The waveform determination module 412 is a computing device that determines the waveforms required to drive display pixels and returns the determined waveform to palette controller 402. In another embodiment, the waveform determination module 412 is a routine executed by a processor for executing the functions of waveform determination module 412. The waveform determination module 412 is communicatively coupled to palette controller 402, waveform table 314, frame buffer 312, committed palette list 416, and current pixel value array 418. In one embodiment, the waveform determination module 412 is also communicatively coupled to waveform library 302.

The waveform determination module 412 receives the desired color for a display pixel in display update region from palette controller 402 and determines the required waveform as described below in FIG. 6B and FIG. 6C. In one embodiment, the waveform determination module 412 retrieves the waveform to drive the display pixel from current color to desired color from waveform library 302. In another embodiment, the waveform determination module 412 computes the waveform instead of retrieving the waveform from the waveform library 302. In yet another embodiment, the waveform determination module 412 first queries the waveform library 302 for the waveform and then computes the waveform if the waveform is not present in waveform library 302.

The expiration module 414 is a computing device that performs the expiration method for a display update region after the display controller 316 has driven the pixels in the display update region. In another embodiment, the expiration module 414 is a routine executed by the processor for executing the expiration method. In this expiration method, the expiration module 414 updates waveform table 314, frame buffer 312, and returns the expired indices to index repository 311. Accordingly, the expiration module 414 is communicatively coupled to the waveform table 314, frame buffer 312, and index repository 311. The expiration method is described below in FIG. 8.

The committed palette list 416 is a storage used to track the expiration of waveforms in waveform table 314 once the waveforms for a particular display update region have been used. One of ordinary skill in the art will understand that committed palette list 416 can store the list of committed palettes in numerous ways like list, stacks, arrays etc. The committed palette list 416 is communicatively coupled to the palette transfer module 408 and expiration module 414. Again, the committed palette list 416 is populated by palette transfer module 408. The committed palette list 416 comprises a representation of one or more frame regions that are being updated, waveforms required to drive the display pixels in the display update region corresponding to the frame region, indices associated with the waveforms, and frame and cycle number of waveform table 314 at which the update to the display update region would be complete. Once the display controller 316 has applied the waveforms to drive the display update region, the expiration module 414 removes from committed palette list 416 information associated with the display update region such as representation of the corresponding frame region, waveforms for the frame region, associated indices, and update completion frame and cycle number.

The current pixel value array 418 is a storage comprising the colors for pixels on physical media 120 including colors for pixels being currently driven and pixels that are not being currently driven. The pixel value array 418 stores the colors being driven to for the pixels that are currently being driven and the current color of pixels for pixels that are not currently being driven. The current pixel value array 418 is communicatively coupled to palette controller 402 and waveform determination module 412. As described in FIG. 6B and FIG. 6C below, the waveform determination module 412 retrieves the current color of pixels from current pixel value array 418 to determine required waveforms for driving a pixel to its desired color. The palette controller 402 updates the pixel values in current pixel value array 418 as described above.

Method Overview

Figure 5A:
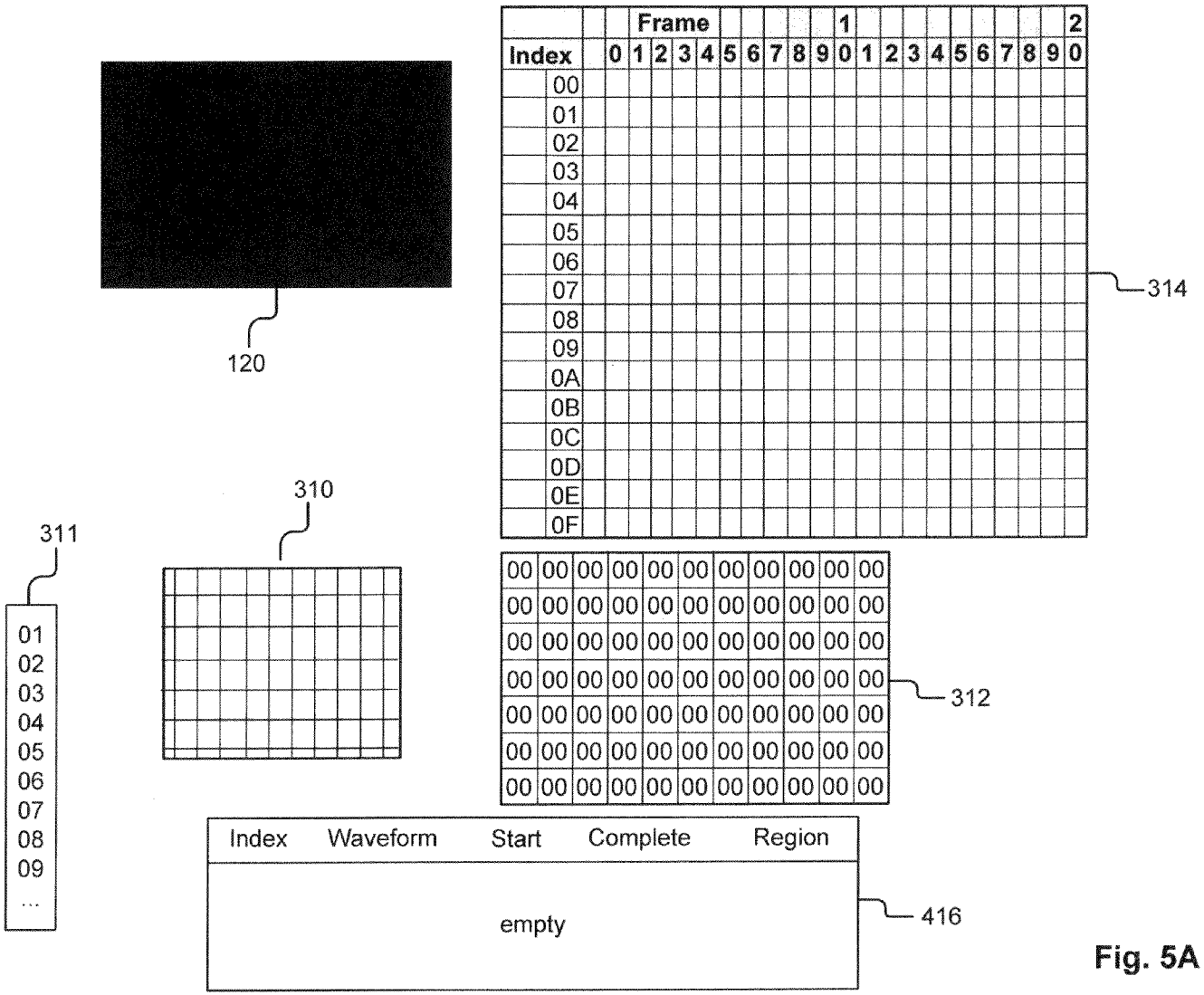
FIGS. 5A-5H are graphical representations of the index repository, current palette, committed palette list, frame buffer, waveform table and physical media at different times during the method for updating the physical media according to an embodiment of the present invention.

FIGS. 5A-5H are graphical representations of different components of the system at different times during the method of updating the physical media 120 to display a new image according to an embodiment of the present invention. FIG. 5A shows graphic representations of physical media 120, the waveform table 314, the current pallet 310, the index repository 311, the frame buffer 312 and the committed palette list 416. Those skilled in the art will recognize that the graphic representations of these components in FIGS. 5A-5H show only portions of these respective components.

In particular, FIG. 5A illustrates the initial state of display system 300 where the physical media 120 shows an image with every pixel set to black, and no updates have been applied to physical media 120. The physical media 120 is not being currently driven and, therefore, the waveform table 314 is empty and does not have any waveforms to be applied to physical media 120. In this state, the committed palette list 416 is empty as waveform table 314 has not yet been updated with any content of current palette 310. The current palette 310 is empty and the frame buffer pixels in frame buffer 312 are initialized to index 00. Because the frame buffer pixels are initialized to index 00, display controller 316 reading the frame buffer pixels would apply the waveform at index 00 in waveform table 314. The waveform table 314 at index 00 does not hold any waveform and the display controller 316 therefore does not apply a waveform to the corresponding display pixels on physical media 120 leading to no change in pixel colors of display pixels on physical media 120. The index 00 in waveform table 314 can be set to numerous values to indicate that the waveform applied to a pixel corresponding to index 00 should not change the current color of the pixel. For example, index 00 can point to a waveform with zero voltage for every frame in waveform table 314 or index 00 in waveform table 314 can be set to null. In either case, the display system 300 in FIG. 5A is in initial state where the display controller 316 has not yet started driving the pixels on the display and is thus not yet updating the current frame number.

The index repository 311 comprises a collection of indices starting from index 01. The index repository 311 does not hold index 00 because index 00 in waveform table 314 does not change and is set as a default to remain in its initial position. For example, index 00 can be set to the null waveform that specifies zero voltage be applied on every frame. Because index 00 remains constant, index 00 is not available to associate with different waveforms in current palette 310 and therefore index repository 311 does not need to track whether index 00 is available or not. In one embodiment, more than one index can be reserved for special purposes like the purpose of index 00.

Figure 5B:
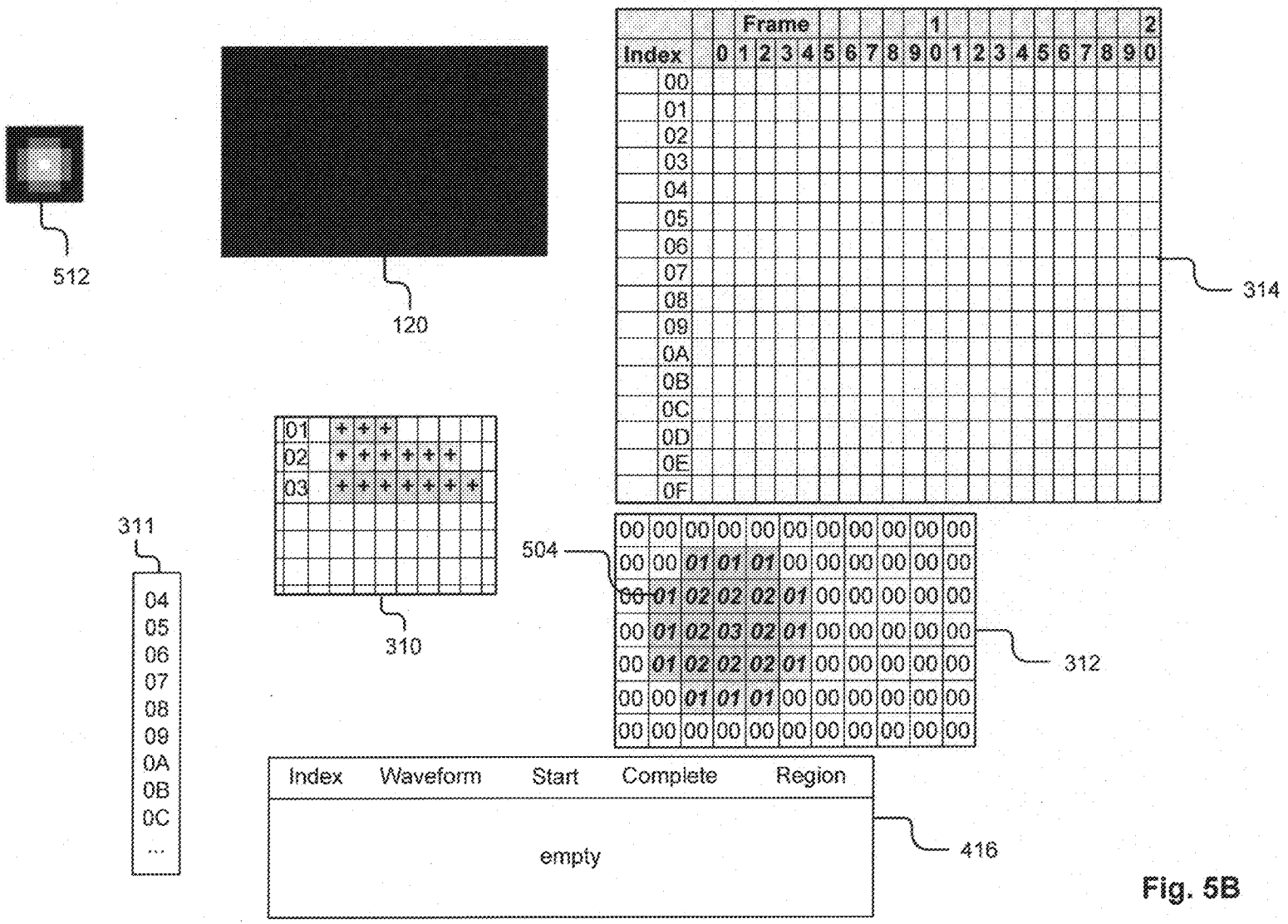

In FIG. 5B, the palette controller 402 receives a first update 512 from the end user application 304 that wants to modify the display from its current state to one in which the first update 512 image is displayed by the physical media 120. The palette controller 402 queries and receives from waveform determination module 412 the required waveforms to drive the display pixels in the physical update region to desired colors, retrieves indices 01-03 from index repository 311, associates the waveforms with the indices, and copies the waveforms and associated indices to current palette 310. The frame buffer controller 404 then updates frame buffer pixels in first frame region 504 that correspond to the first update 512. Here, an entry in a waveform denoted with a plus sign ('+') indicates that a voltage should be applied to drive the corresponding pixel towards white (i.e. higher reflectance), while an entry denoted with a minus sign ('−') indicates that a voltage should be applied to drive the corresponding pixel towards black (i.e. lower reflectance). A blank entry indicates that zero voltage should be applied during the corresponding frame.

Figure 5C:
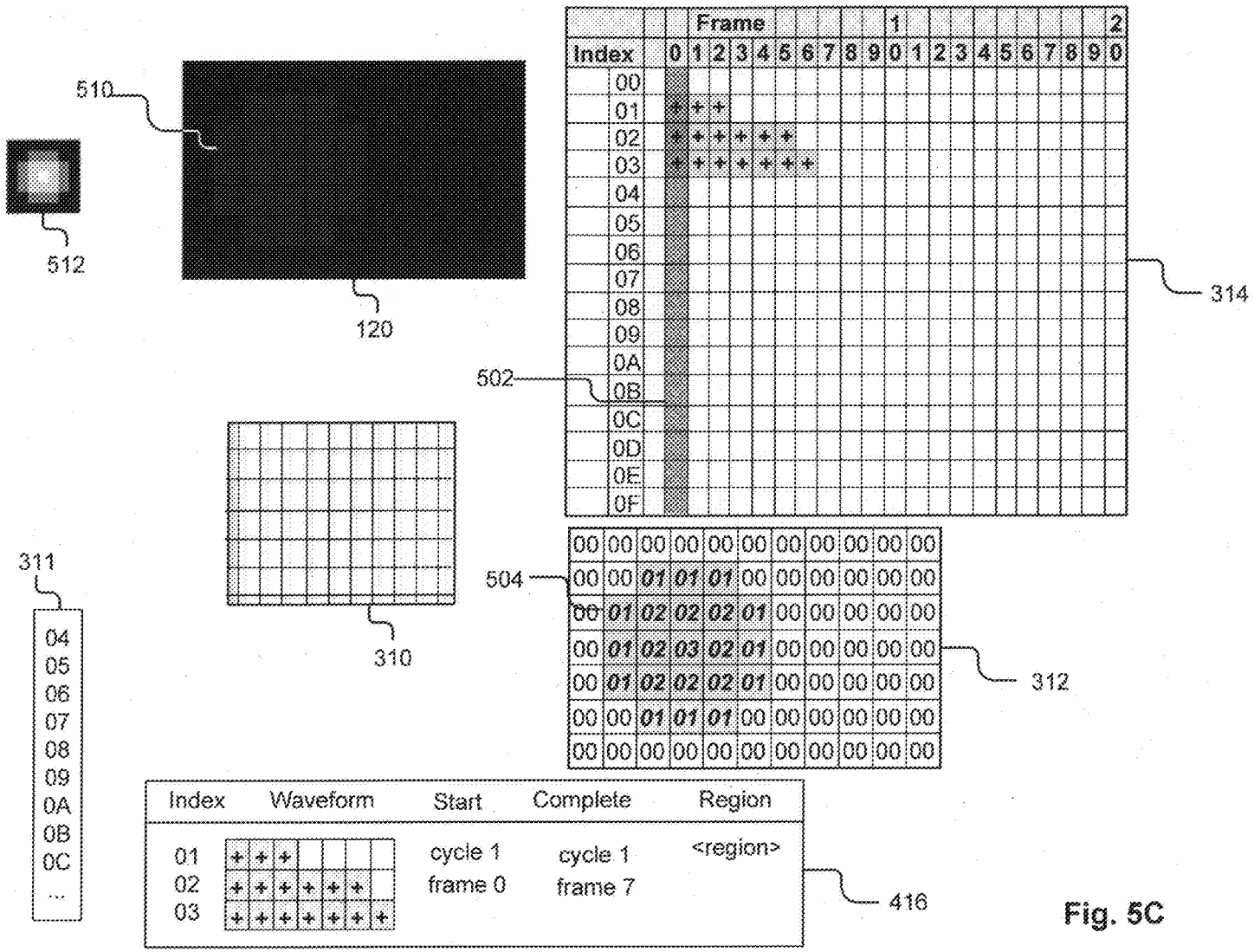

As illustrated in FIG. 5C, the palette transfer module 408 then updates various indices of waveform table 314 with corresponding waveforms from current palette 310. The waveform associated with index 01 in current palette 310 is copied to index 01 of waveform table 314. Similarly, waveforms associated with indices 02 and 03 are also copied in waveform table 314. As shown in FIG. 5C, the palette transfer module 408 also copies the waveform and associated indices from current palette 310 to committed palette list 416. Additionally, the palette transfer module 408 determines the cycle number and frame number of the waveform table 314 at which the update for first update 512 would be complete. As illustrated in FIG. 5C, the waveforms corresponding for first update 512 extend from frame 0 to frame 6 of cycle 1 in waveform table 314. The update therefore will complete at frame 7 of cycle 1 in waveform table 314 and palette transfer module 408 copies this completion frame number and cycle number in committed palette list 416. The palette transfer module 408 also determines the start cycle and frame number for the current palette and copies the start cycle and frame number to the committed palette list 416. In FIG. 5C, the start cycle and frame number is the current cycle number and frame number, i.e. cycle 1 frame 0. The palette transfer module 408 then clears the current palette 310.

The display controller 316 reads the frame buffer 312 (as indicated by the shaded region 502), determines the indices associated with various pixels, reads the first frame of waveform table 314, determines the parts of the waveforms associated with read indices, and applies those parts of waveforms to display pixels corresponding to the frame buffer pixels. Consequently, the colors of various display pixels in first display update region 510 start transitioning to desired colors and the image displayed on physical media 120 in FIG. 5C appears. The display controller 316 then reads from frames 1 and 2 of waveform table 314 and repeats the above stated process.

Figure 5D:
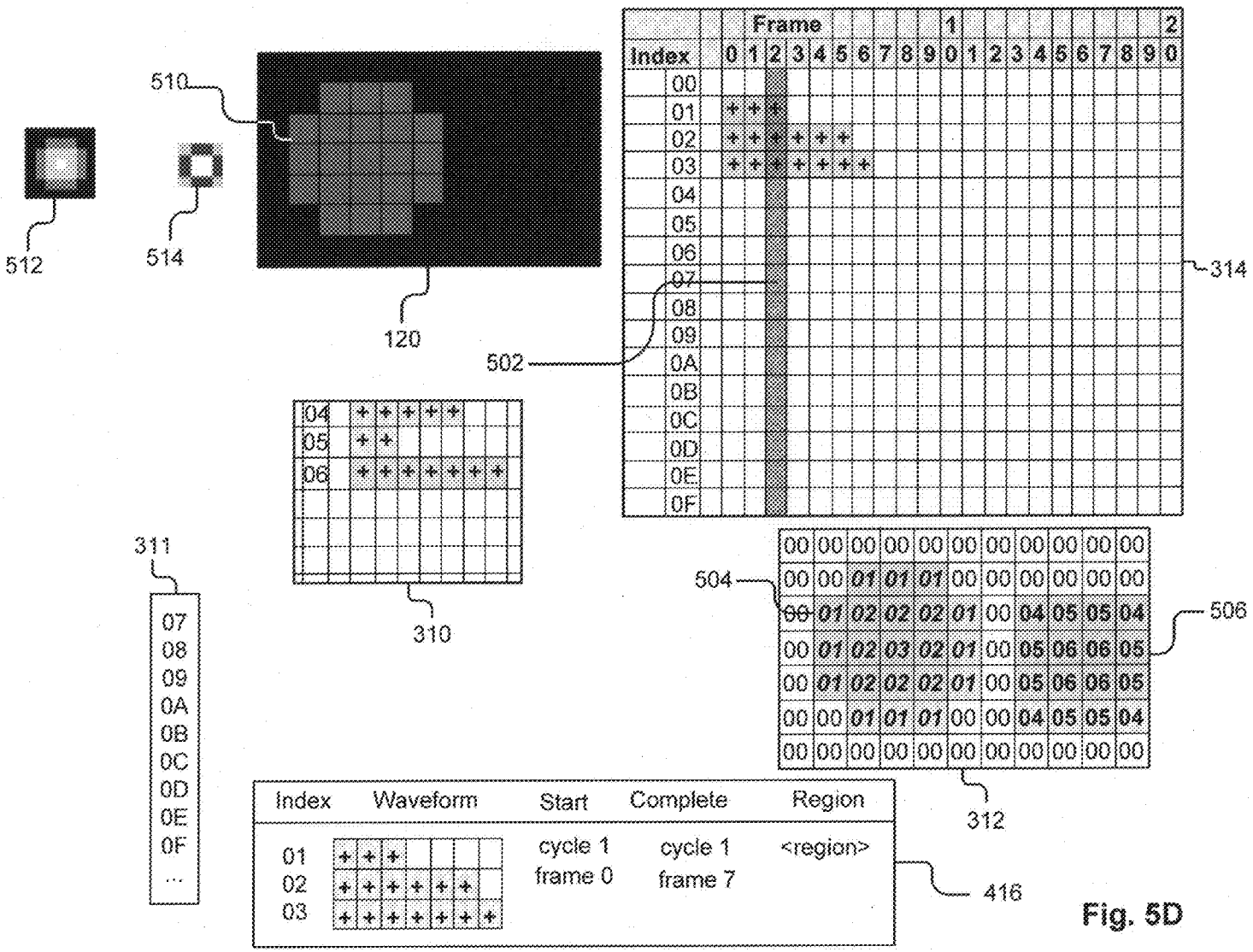

To illustrate concurrent updates, assume that while the display controller 316 reads from frame 2, the palette controller 402 receives a second update 514 as illustrated in FIG. 5D. The palette controller 402 receives from waveform determination module 412 the required waveforms to drive the display pixels that correspond to the second update 514, retrieves indices 04-06 from index repository 311, associates the waveforms with the indices, and copies the waveforms and associated indices to current palette 310. The frame buffer controller 404 then updates frame buffer pixels in a second frame region 506 of frame buffer 312 that correspond to the second update 514.

In this illustrative example, the second update 514 is received while the display controller 316 is reading values from frame buffer 312 for frame 2. Depending on the timing, some, all, or none of the changes made to frame buffer 312 corresponding to second update 514 will be included in the data read by display controller 316 for frame 2. However, because the waveform table 314 does not yet include any waveforms at indices corresponding to the second update 514, the display controller 316 does not apply any voltage to the second display region of physical media 120 during the second frame. Accordingly, the second update 514 does not affect the update of physical media 120 until both the frame buffer 312 and waveform table 314 have been updated to account for second update 514. The palette controller 402 therefore does not have to account for timing issues associated with display controller 316. The display controller 316 starts applying the second update 514 to physical media 120 after the palette controller 402 populates the waveform table 314, which only happens after frame buffer controller 404 has populated the frame buffer 312 with indices corresponding to second update 514.

Figure 5E:
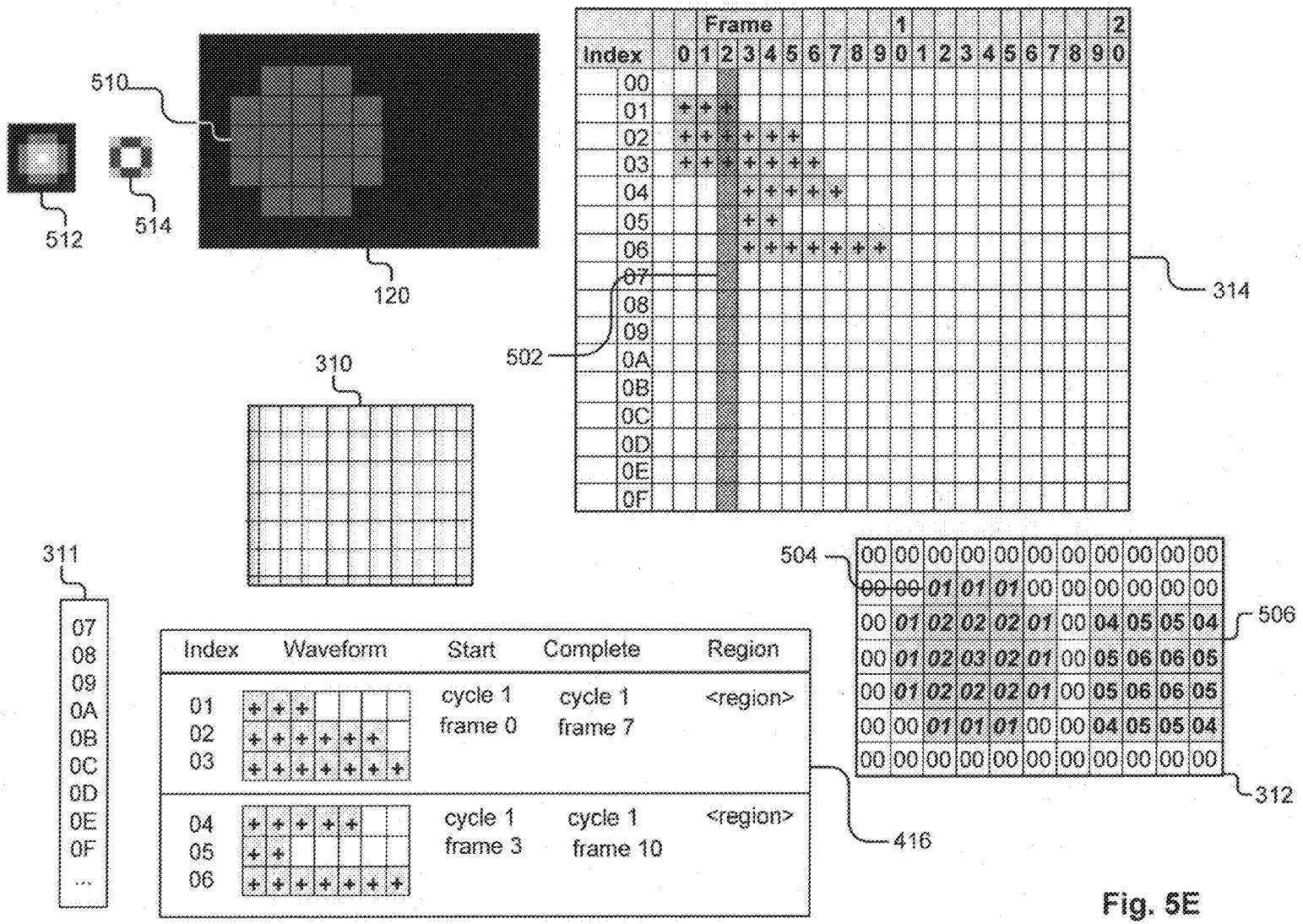

After the second frame region 506 in frame buffer 312 has been updated, the palette transfer module 408 in FIG. 5E updates waveform table 314 with corresponding waveforms from current palette 310, populates the committed palette list 416 with information related to the second update 514, and clears current palette 310 as described in context of first update 512 above.

Figure 5F:
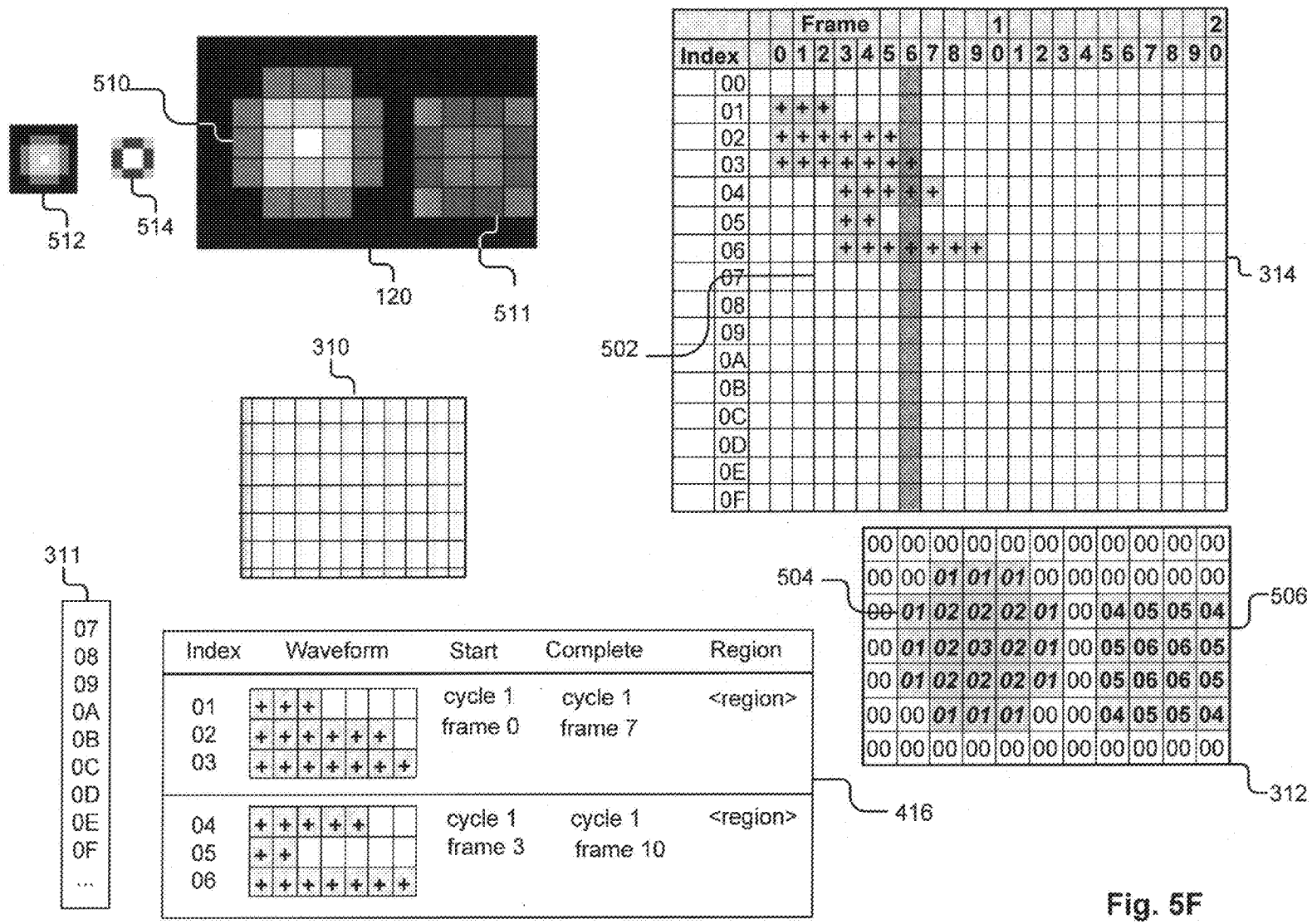

The display controller 316 then reads parts of the waveforms from frames 3-6 of waveform table 314 and applies them to physical media 120 at appropriate display pixels as described above. FIG. 5F illustrates the display system 300 while the display controller 316 reads frame 6 of waveform table 314. Because the display controller now reads from a frame buffer 312 with two update regions 504, 506, the display controller 316 applies waveforms for the two updates simultaneously from frames 3-6.

Figure 5G:
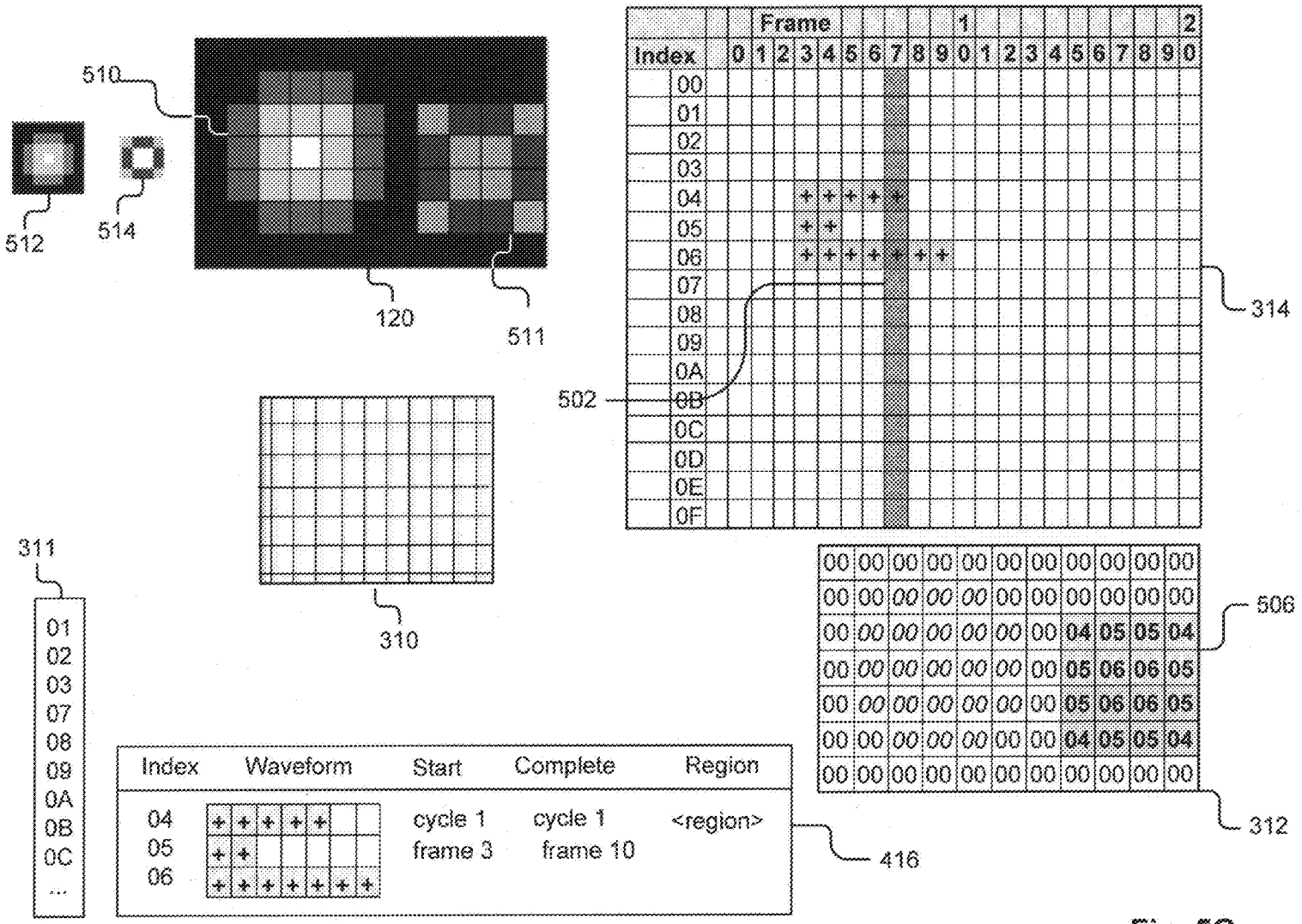

At frame 7, the first update 512 is complete and the pixels in first display region 510 have been driven to the desired colors. Accordingly, as illustrated in FIG. 5G, the expiration module 414 clears the waveforms for first update 512 from waveform table 314. The timing constraints for this action are relatively loose. Because the expired waveform contain null entries (which indicate zero voltage and thus no change to a pixel) for frames 7 and above, the expiration module 414 may clear the expired waveforms from waveform table 314 during any frame after frame 6 and before the first frame of the next cycle. Once the expired waveforms have been cleared from waveform table 314, even if the display controller 316 reads the frame buffer 312 before the frame buffer pixels associated with first update 512 are stabilized, the waveform table 314 does not include waveforms for transitioning the corresponding display pixel to the desired value for the first frame region 504. The display controller 316 therefore does not apply any additional waveforms to corresponding display pixels in first display region 510 of physical media 120.

The expiration module 414 then stabilizes the pixels in first frame region 504. In other words, the expiration module 414 sets the frame buffer pixels to an index that does not include a waveform and is not included in index repository 311. The expiration module 414 also returns the first set of indices 01-03 to index repository 311 and removes the information associated with first update 512 from committed palette list 416.

Figure 5H:
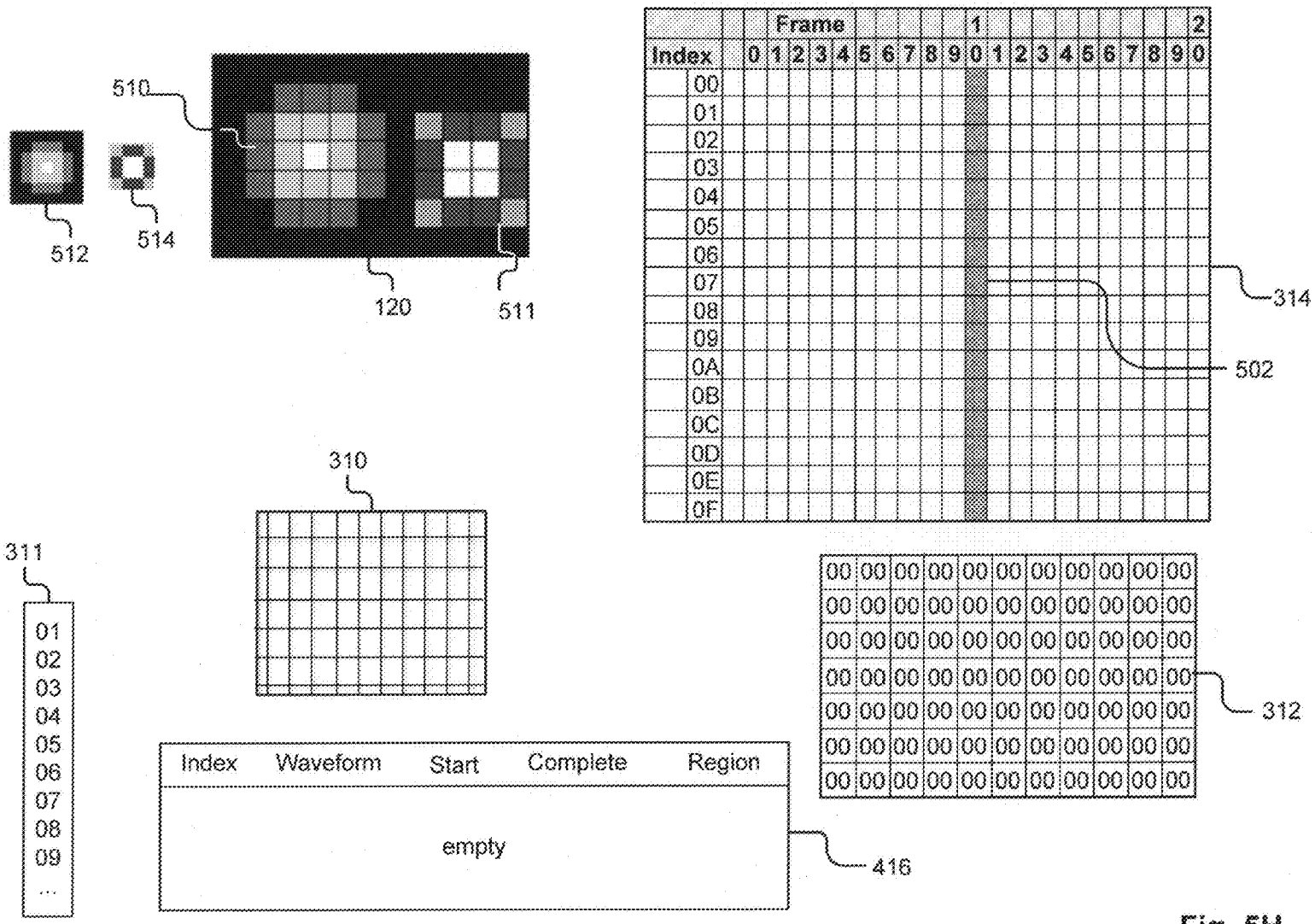

The display controller 316 then continues reading from frames 7-9 of waveform table 314. At frame 10, as illustrated in FIG. 5H, the display controller 316 has completed the second update to physical media 120. The physical media 120 therefore displays the first update 510 and the second update 511. The expiration module 414 repeats for the second update 514 steps similar to steps associated with completion of first update 512. As a result, the waveform table 314 does not include waveforms associated with second update 514, the second frame region 506 is stabilized, the index repository 311 gets the second set of indices back for reuse, and information associated with second update 514 is removed from committed palette list 416.

Figure 6A:
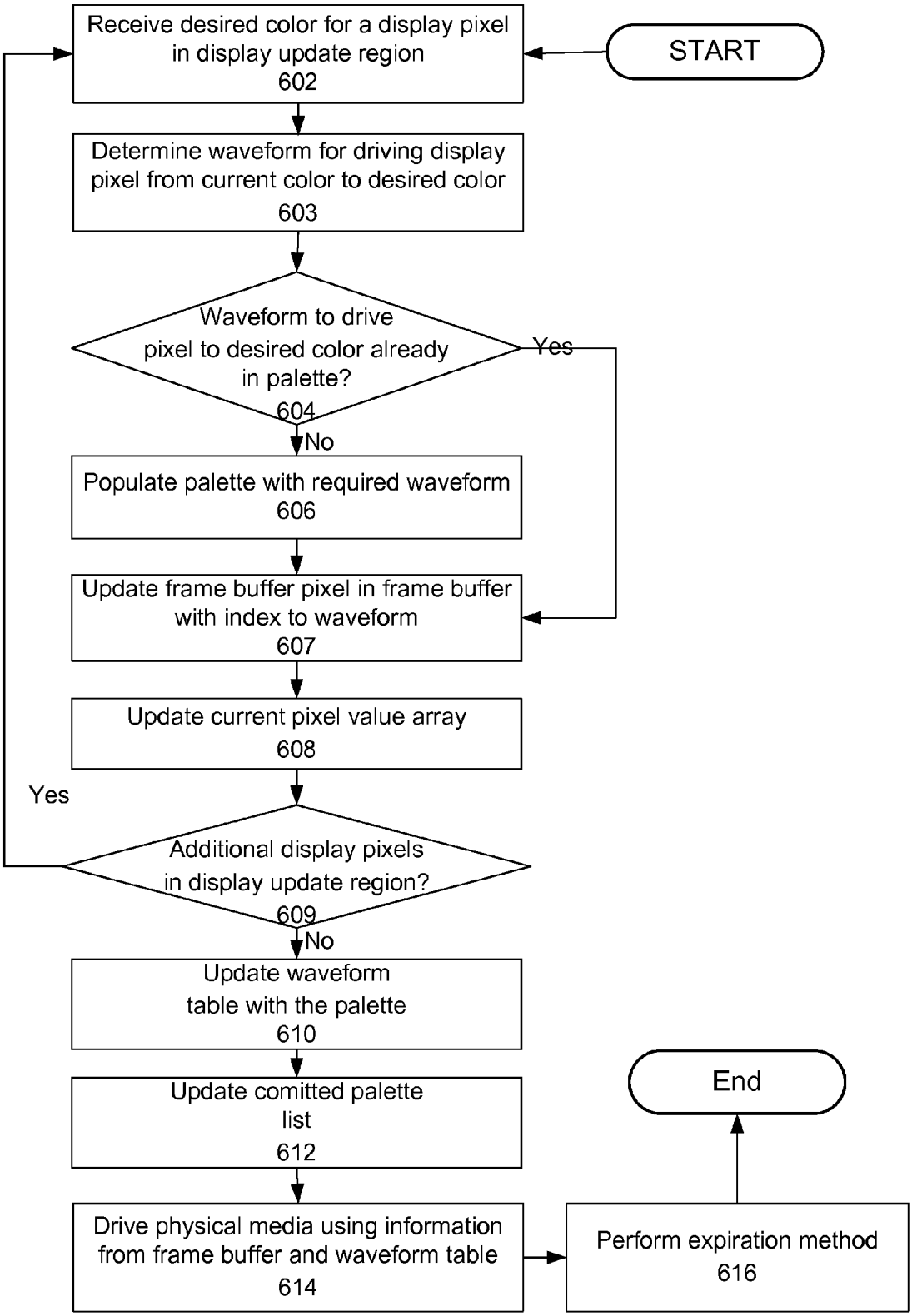
FIG. 6A illustrates a flow chart of an embodiment of a method for driving one or more pixels in an update region on the physical media according to the present invention.

FIG. 6A illustrates a flow chart describing the method used to drive one or more physical pixels in a display update region on the physical media 120 according to one embodiment of the invention. The palette controller 402 of the update controller 308 receives 602 the desired color for a display pixel in the display update region. The palette controller 402 provides the waveform determination module 412 with the corresponding frame buffer pixel and its corresponding desired color and queries the waveform determination module 412 for a waveform to drive the physical pixel from its current color to the desired color. The waveform determination module 412 determines the current color for the display pixel from current pixel value array 418, retrieves or computes 603 the required waveform and returns the waveform to palette controller 402. The method for determining 603 the waveform is described in more detail below with reference to FIG. 6B.

After the palette controller 402 receives the waveform, the palette controller 402 determines 604 if the palette controller 402 has already populated the current palette 310 with that same waveform for another pixel. For the purposes of this determination, two waveforms are considered to be the same if they both consist of the same sequence of voltage pulses and both either interrupt the same waveform that is currently being driven or both do not interrupt another waveform. If the palette controller 402 has not already populated the current palette 310 with the same waveform for another pixel, the palette controller 402 populates 606 the current palette 310 with the waveform and the index. Otherwise, the palette controller 402 skips populating the current palette 310 as the waveform already exist in the current palette 310. One embodiment of a method for populating 606 the current palette 310 is described in more detail below with reference to FIG. 6D.

Next, the palette controller 402 signals the frame buffer controller 404 and the frame buffer controller 404 updates 607 the frame buffer pixel with index of the waveform in current palette 310. The palette controller 402 also updates 608 the appropriate pixel location of the current pixel value array 418 with the desired color. If additional display pixels exist 609 in the display update region, steps 602-608 are repeated for those display pixels. If not, the palette transfer module 408 transfers 610 the waveforms from current palette 310 to corresponding indices in waveform table 314. One embodiment of this method is described in more detail below with reference to FIG. 7.

The palette transfer module 408 then updates 612 the committed palette list 416 with contents of the current palette 310, the frame region corresponding to display update region, and frame number and cycle number of waveform table 314 at which the update will complete. The display controller 316 then drives 614 the display pixels on physical media 120 using the indices from frame buffer 312 and corresponding waveforms from waveform table 314. After the update, the indices and corresponding waveforms expire and the expiration module 414 performs 616 the expiration method. One embodiment of this method is described in more detail with reference to FIG. 8.

Figure 6B:
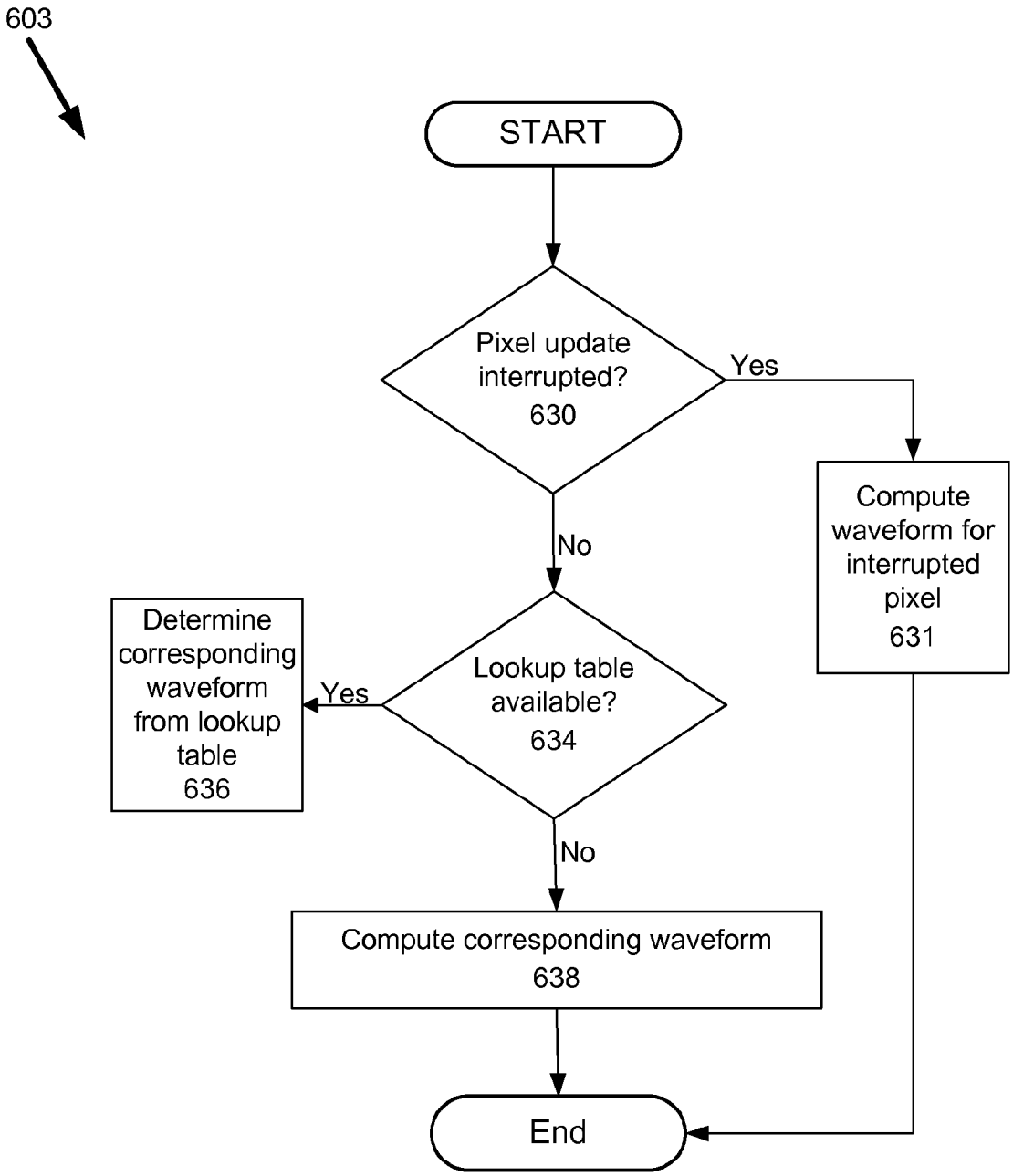
FIG. 6B illustrates a flow chart of an embodiment of a method for determining the waveform for driving the pixel from a current color to a desired color according to the present invention.

FIG. 6B illustrates the method for determining 603 the waveform for driving the physical pixel from current color to desired color. After receiving the frame buffer pixel and the desired color, the waveform determination module 412 determines 630 if the physical pixel corresponding to frame buffer pixel is being driven and therefore if the drive for that pixel will be interrupted. For this determination, the waveform determination module 412 checks the frame buffer pixel in frame buffer 312 to determine if the frame buffer pixel has been stabilized. If the frame buffer pixel has not been stabilized, the waveform determination module 412 determines 630 that the pixel drive has been interrupted and the waveform determination module 412 computes 631 the waveform for the interrupted pixel. This computation method is described below in FIG. 6C.

If the frame buffer pixel has been stabilized, the waveform determination module 412 determines 630 that the pixel's drive is not being interrupted. Consequently, the waveform determination module 412 queries the waveform library 302 and determines 634 if a waveform lookup table comprising the requested waveform exists in waveform library 302. If yes, the waveform determination module 412 retrieves 636 the requested waveform from the lookup table. If, however, the lookup table or the waveform library 302 does not exist, the waveform determination module 412 computes 638 the requested waveform and returns the retrieved or computed waveform to palette controller 402.

The waveform determination module 412 computes 638 the requested waveform through linear extrapolation from pre-determined number of frames to apply a voltage required to drive a pixel from one color to another. For example, the waveform determination module 412 can be pre-configured with the number of frames, for e.g. eight frames, of positive voltage required to drive a pixel from gray level 15 (i.e. white) to gray level 0 (i.e. black). The waveform determination module can extrapolate from this pre-configured data various colors to drive a pixel from one color to another. For example, the waveform determination module 412 can extrapolate from the above mentioned numbers that driving a pixel from gray level 0 to gray level 15 would require eight frames of negative voltage. Similarly, driving a pixel from gray level 5 to gray level 1 would require two (floor((5−1)/16)*8) frames of positive voltage.

Figure 6C:
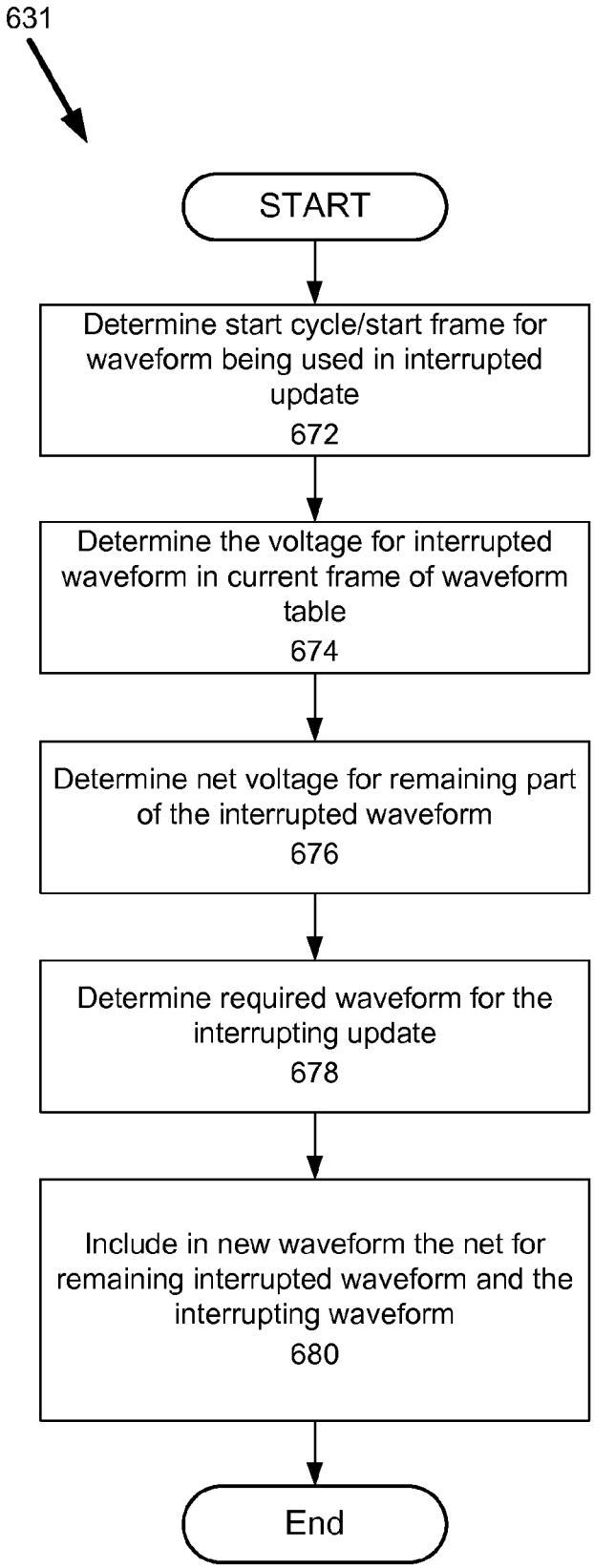
FIG. 6C illustrates a flow chart of an embodiment of method for computing waveform for a pixel whose drive is interrupted by a subsequent update according to the present invention.

FIG. 6C illustrates an embodiment of the method for computing 631 waveform for a pixel whose drive is interrupted by a subsequent update. After determining 630 that a pixel's drive has been interrupted, the waveform determination module 412 determines 672 the cycle number and frame number in waveform table 314 at which the interrupted drive started. Accordingly, the waveform determination module 412 reads the frame buffer 312 and determines the interrupted index currently associated with the interrupted frame buffer pixel corresponding to the interrupted pixel. The waveform determination module 412 then queries the committed palette list 416 to determine 672 the start cycle and frame for the waveform associated with the interrupted frame buffer pixel.

The waveform determination module 412 then queries the waveform table 314 for the current cycle number and current frame number. The waveform determination module 412 uses this current frame and cycle number with previously determined start cycle number and frame number to determine 674 the voltage in the current frame for interrupted waveform associated with the interrupted index.

The waveform determination module 412 next determines 676 net voltage for the interrupted waveform remaining in frames after the current frame. For example, if the remaining interrupted waveform includes three frames of positive voltage pulses, followed by two frames of negative voltage pulses, the net voltage for the remaining interrupted waveform would be one positive voltage pulse.

Next, the waveform determination module 412 determines 678 the waveform required for driving the interrupted pixel to a new desired color specified by the interrupting update that interrupted the previous drive. The waveform determination module 412 reads the appropriate pixel location in current pixel value array 418 to determine the color that the interrupted pixel is being driven to. The waveform determination module 412 uses this color value and the new desired color value from the interrupting drive to determine 678 the required waveform.

The waveform determination module 412 then creates 680 a new waveform whose length and sign are determined by adding the net voltage remaining in the interrupted waveform plus the net voltage of the waveform required to drive the pixel from the color to which the interrupted pixel is being driven, to the new desired color value. For example, if the net voltage remaining in the interrupted waveform is one positive voltage pulse and the waveform required to reach the new desired color value consists of a sequence of three positive voltage pulses, the resulting new waveform will consist of a sequence of four positive voltage pulses (1+3=4). If, on the other hand, the net voltage remaining in the interrupted waveform is one positive voltage pulse and the waveform required to reach the new desired color value consists of a sequence of three negative voltage pulses then the resulting new waveform will consist of two negative voltage pulses (1+(−3)=−2).

In one embodiment, the waveform determination module 412 does not create 680 the new waveform for the interrupted pixel by determining the net remaining charge in the interrupted waveform. Instead, the waveform determination module 412 treats the interrupting drive as a drive following the interrupted drive. The waveform determination module 412 therefore determines a waveform that would drive the interrupted pixel from the color it was being driven to by the interrupted waveform to the desired color specified by the interrupting drive.

In either embodiment, the waveform determination module 412 will indicate to the palette controller 402 that a determined waveform is for an interrupted pixel by returning a pointer to the interrupted waveform along with the new determined waveform.

Figure 6D:
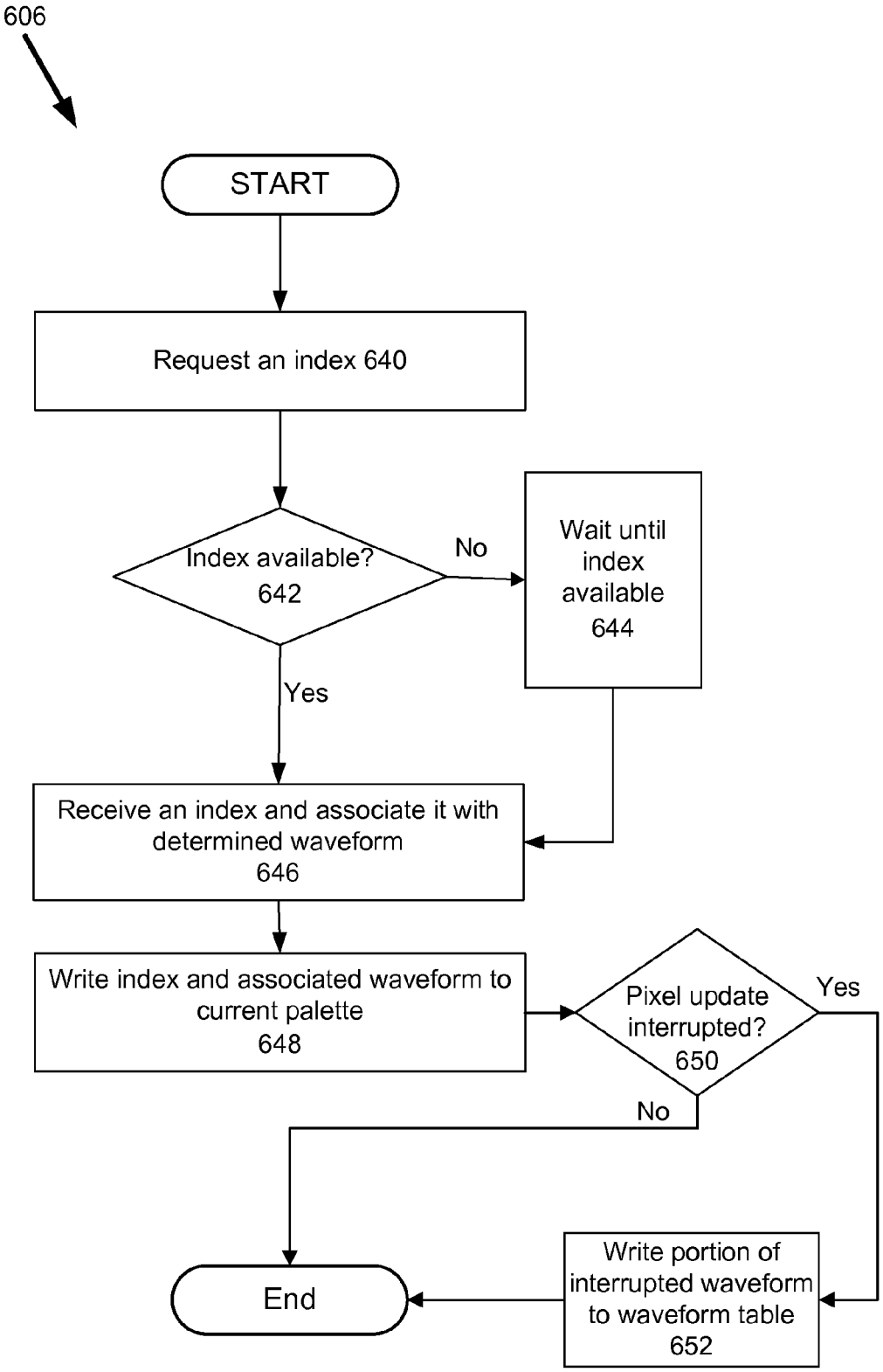
FIG. 6D illustrates a flow chart of an embodiment of method for populating the current palette with required waveform according to the present invention.

FIG. 6D illustrates an embodiment of the method for populating 606 the current palette 310 with the retrieved waveform according to the present invention. To populate the current palette 310 with the waveform, the palette controller 402 requests 640 an index for the waveform from index repository controller 406. The index repository controller 406 determines 642 if an index is available in the index repository 311. If not, the index repository controller 406 waits 644 until an index is returned to the index repository 311 and the index becomes available. Otherwise, the index repository controller 406 returns an index to palette controller 402. The palette controller 402 receives 646 the index, associates it with the waveform, and writes 648 the waveform and the associated index to current palette 310. The palette controller 402 then checks 650 whether the waveform was determined based on a pixel that was already being driven to a previous value. If so, then palette controller 402 copies some portion of the remainder of the interrupted waveform to the entry for the index of the interrupting waveform in waveform table 314, starting at the current frame. In one embodiment, only the voltage pulse of the current frame of the interrupted waveform is copied to the entry for the index of the interrupting waveform in waveform table 314, with the voltage pulse calculated based on the starting cycle and frame of the interrupted waveform and the current cycle and frame of waveform table 314. In another embodiment, all remaining voltage pulses of the interrupted waveform starting with the voltage pulse to be written in the current frame are copied to the entry for the index of the interrupting waveform in waveform table 314, starting with the current frame.

Figure 7:
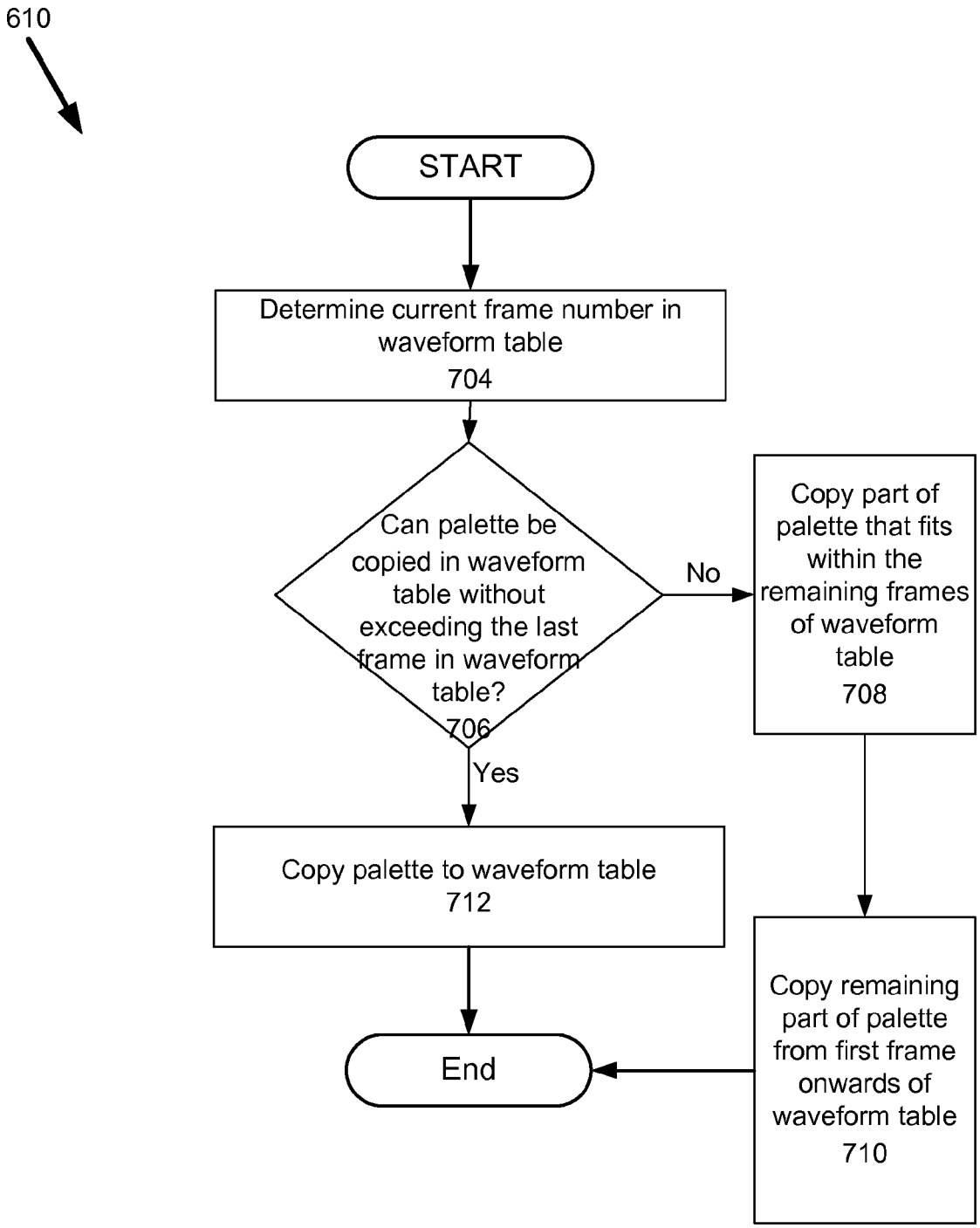
FIG. 7 illustrates a flow chart of an embodiment of method for transferring contents of the current palette to waveform table according to an embodiment of the present invention.

FIG. 7 illustrates a method for transferring 610 contents of the current palette 310 to waveform table 314 according to an embodiment of the invention. The palette transfer module 408 determines 704 the current frame number in waveform table 314 that is being read by display controller 316.

The palette transfer module 408 then determines 706 if the longest waveform in current palette 310 is shorter than the remaining frames in the current cycle of waveform table 314. If the current palette includes an interrupting waveform, the palette transfer module 408 determines if the current frame in waveform table 314 is already past the last frame including pulses from the interrupted waveform. If yes, the palette transfer module 408 determines if the interrupting waveform would fit in the frames remaining after the current frame. If not, the palette transfer module 408 determines if the interrupting waveform would fit in the frames remaining after the last frame that includes the interrupting waveform.

If the longest waveform and the interrupting waveforms would fit into the current cycle, the palette transfer module 408 copies 712 waveforms from current palette 310 to waveform table 314 starting at the frame following current frame in the waveform table 314. In one embodiment, waveforms that drive interrupted pixels are copied from current palette 310 to waveform table 314 at the index of the interrupting waveform (that is, the index to which part of the interrupted waveform was previously copied). The interrupting waveform is copied starting either at the frame following the current frame or at the frame following the last frame of the copied region of the interrupted waveform, whichever is later.

In the case where the current frame is the last frame in the waveform table 314, the following frame is the first frame of the waveform table 314. If the longest waveform in current palette 310 is not shorter than the remaining frames in the current cycle of waveform table 314, the palette transfer module 408 copies 708 parts of the waveforms to waveform table 314 starting at frame following current frame until the last frame in current cycle of waveform table 314. In one embodiment, parts of waveforms that drive interrupted pixels are copied from current palette 310 to waveform table 314 starting either at the frame following the current frame or at the frame following the last frame of the copied region of the interrupted waveform, whichever is later. The palette transfer module 408 copies 710 the remaining parts of the waveforms from first frame onwards of the next cycle of waveform table 314.

Figure 8:
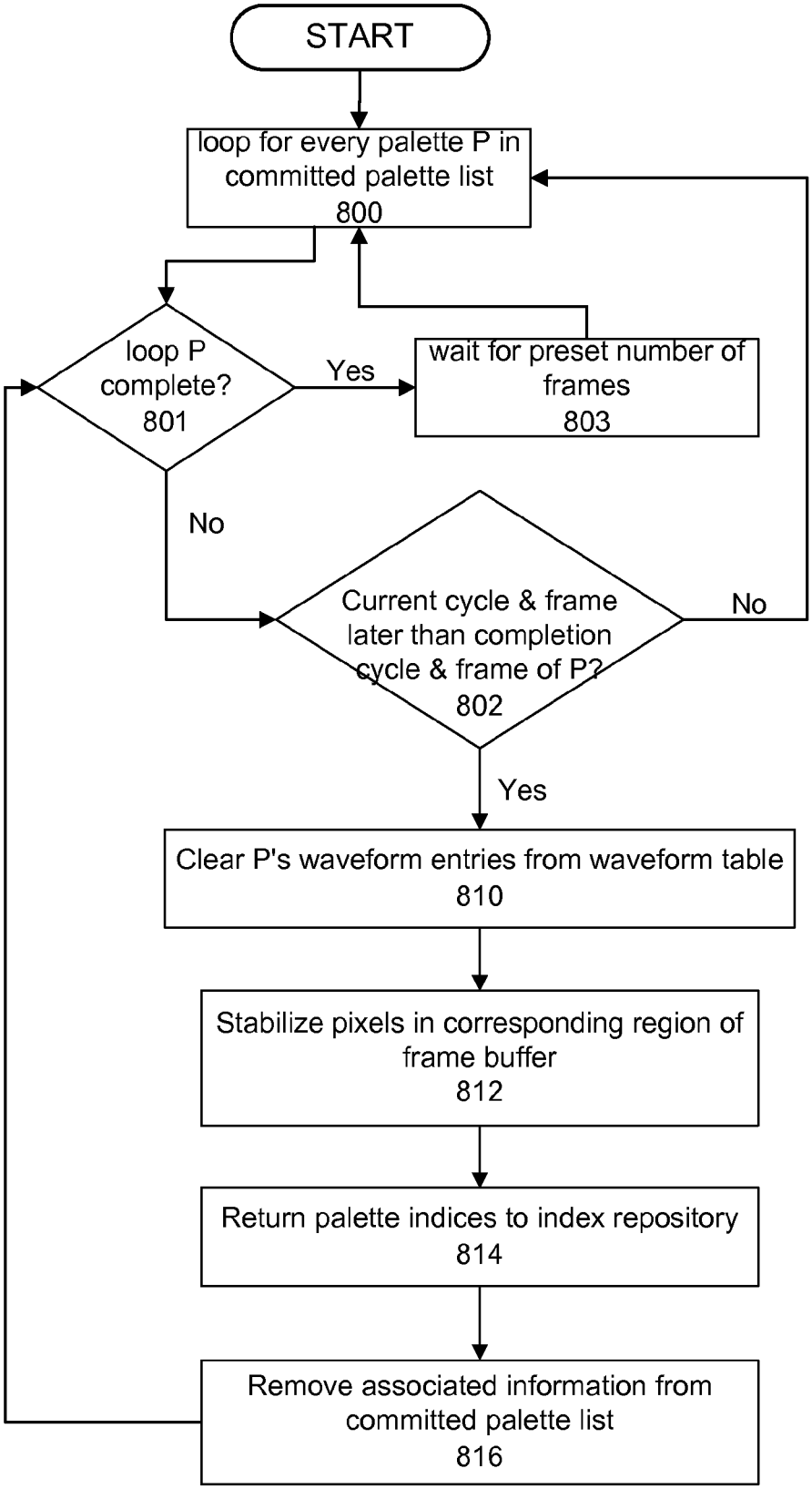
FIG. 8 illustrates a flow chart of an embodiment of expiration method performed by an expiration module of an update controller according to an embodiment of the present invention.

FIG. 8 illustrates the expiration method performed by expiration module 414 according to some embodiments of the invention. The expiration module 414 performs 800 a loop to examine each palette in the committed palette list 416. If all palettes in the committed palette list 416 have been examined 801, the expiration module 414 waits 803 for a preset period of time (typically on the order of a few frames) and then repeats the loop over the palettes in the committed palette list 800. Otherwise, the expiration module 414 determines 802 whether the display controller 316 has completed reading the frames from waveform table 314 that include the longest waveform in the examined palette. In other words, the expiration module 414 determines if the palette has expired. To do so, the expiration module 414 determines 802 whether the current frame of the current cycle in waveform table 314 is later than the completion cycle and frame for the examined palette. This will be true if either the current cycle in waveform table 314 is greater than the completion cycle of the examined palette, or if the current cycle number in waveform table 314 is equal to the completion cycle of the examined palette and the frame number in waveform table 314 is greater than the completion frame of the examined palette. If neither case is true, the expiration module 414 jumps back to the start of the loop 800 and examines the next palette in the completed palette list 416. If the examined palette has expired, the expiration module 414 signals the palette controller 402 and the palette controller 402 clears 810 the waveforms from waveform table 314 that correspond to the waveforms of the expired palette.

The expiration module 414 then signals the frame buffer controller 404 and the frame buffer controller 404 stabilizes 812 the frame buffer pixels in corresponding frame region. Next, the expiration module 414 returns 814 the indices associated with expired waveforms to index repository 311. The expiration module 414 next removes 816 the information associated with the expired palette from committed palette list 416. The expiration module 414 then jumps back to the start of loop 800 and examines the next palette in the completed palette list 416.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

The invention claimed is:

1. A system for driving a first display pixel in a display update region of a physical media, the system comprising:

a frame buffer comprising a plurality of frame buffer pixels corresponding to a plurality of display pixels on the physical media, the plurality of frame buffer pixels capable of storing indices to waveforms;

a waveform table comprising a plurality of waveform table indices capable of storing the waveforms;

an update controller, communicatively coupled to the frame buffer and the waveform table for:

receiving a first desired color for the first display pixel on the physical media;

determining a first waveform to drive the first display pixel to the first desired color;

updating a first frame buffer pixel in the frame buffer corresponding to the first display pixel with a first index associated with the first waveform;

after updating the first frame buffer pixel, updating the waveform table with the first waveform at a first waveform table index;

receiving a second desired color for the first display pixel to interrupt the driving of the first display pixel to the first desired color based on determining that the first display pixel is not stabilized;

creating a second waveform to drive the first display pixel to the second desired color whose length and sign are determined by adding a first net voltage remaining in the first waveform plus a second net voltage used to drive the first display pixel from a current color to which the first pixel is being driven to the second desired color;

receiving a third desired color for a second display pixel on the physical media while the driving of the first display pixel is incomplete; and determining a third waveform to drive the second display pixel to the third desired color;

a display controller, communicatively coupled to the waveform table and the frame buffer, for retrieving the first index from the first frame buffer pixel and corresponding first waveform from the first waveform table index, and for applying the interrupted first waveform and the second waveform to the first display pixel and for applying the third waveform to the second display pixel concurrently; and an expiration module, communicatively coupled to the waveform table, for determining that a current frame of a current cycle in the waveform table is later than a completion cycle and frame for the first frame buffer pixel, signaling a frame buffer controller to stabilize the first frame buffer pixel and returning the first index to an index repository.

2. The system of claim 1 wherein the update controller comprises:

a palette controller for receiving the first desired color and the second desired color for the first display pixel;

a waveform determination module, communicatively coupled to the palette controller, for determining the first waveform to drive the first display pixel to the first desired color and determining the second waveform to drive the first display pixel to the second desired color;

the frame buffer controller, communicatively coupled to the palette controller, for updating the first frame buffer pixel in the frame buffer with the first index associated with the first waveform; and a palette transfer module, communicatively coupled to the palette controller, for updating the waveform table with the first waveform.

3. The system of claim 2 wherein the update controller comprises a waveform library coupled to the waveform determination module, the waveform library including pre-determined waveforms to drive the plurality of display pixels from one color to another color, and the waveform determination module determines the first waveform to drive the first display pixel by retrieving one of the pre-determined waveforms from the waveform library.

4. The system of claim 2 wherein the waveform determination module determines the first waveform to drive the first display pixel by computing the first waveform.

5. The system of claim 2 wherein the palette controller is configured to retrieve the first index from the index repository, associate the first index with the first waveform and store the first index and the first waveform in a current palette, the system comprising:

the index repository, communicatively coupled to the palette controller, including a pool of available indices available to be associated with various waveforms; and the current palette, communicatively coupled to the palette controller, for storing the waveforms and associated indices to drive the plurality of display pixels in the display update region.

6. The system of claim 2 wherein the palette controller is configured to receive the first waveform from the waveform determination module and store the first waveform with the associated index in a current palette, and the palette transfer module is configured to retrieve the first waveform from the current palette and update the waveform table with the first waveform, the system comprising:

the current palette, coupled to the palette controller, for storing the indices and associated waveforms for driving the plurality of display pixels in the display update region to their desired colors.

7. The system of claim 2 wherein the expiration module is configured to remove the waveforms and associated indices from the waveform table and reset the plurality of frame buffer pixels corresponding to the associated indices.

8. A method for driving a first display pixel in a display update region of a display, the method comprising:

receiving a first desired color for the first display pixel;

determining a first waveform to drive the first display pixel to the first desired color;

updating a first frame buffer pixel in a frame buffer corresponding to the first display pixel with a first index associated with the first waveform;

updating a waveform table with the first waveform after updating the first frame buffer pixel;

receiving a second desired color for the first display pixel to interrupt the driving of the first display pixel to the first desired color based on determining that the first display pixel is not stabilized;

creating a second waveform to drive the first display pixel to the second desired color whose length and sign are determined by adding a first net voltage remaining in the first waveform plus a second net voltage used to drive the first display pixel from a current color to which the first pixel is being driven to the second desired color;

receiving a third desired color for a second display pixel while the driving of the first display pixel is incomplete;

determining a third waveform to drive the second display pixel to the third desired color;

applying the interrupted first waveform and the second waveform to the first display pixel and applying the third waveform to the second display pixel concurrently;

determining that a current frame of a current cycle in the waveform table is later than a completion cycle and frame for the first frame buffer pixel;

stabilizing the first frame buffer pixel; and returning the first index to an index repository.

9. The method of claim 8 wherein determining the first waveform to drive the first display pixel comprises retrieving the first waveform from a waveform library that includes pre-determined waveforms to drive display pixels from one color to another color.

10. The method of claim 8 wherein determining the first waveform to drive the first display pixel comprises computing the first waveform.

11. The method of claim 8 wherein the first index associated with the first waveform is retrieved from the index repository that includes a pool of available indices available to be associated with various waveforms.

12. The method of claim 8 wherein applying the third waveform to the second display pixel comprises:

updating a second frame buffer pixel in the frame buffer corresponding to the second display pixel with a second index associated with the third waveform; and updating the waveform table with the third waveform, wherein updating the waveform table with the first waveform and the third waveform comprises:

updating a current palette with the first index, the first waveform, the second index and the third waveform; and updating a first waveform table index and a second waveform table index in the waveform table with the first waveform and the third waveform after updating the current palette with the first waveform and the third waveform.

13. The method of claim 8 wherein applying the third waveform to the second display pixel comprises:

determining that the first waveform can be used as the third waveform to drive the second display pixel to the third desired color;

updating a second frame buffer pixel in the frame buffer corresponding to the second display pixel with the first index; and updating the waveform table with the first waveform.

14. The method of claim 13 wherein updating the waveform table with the first waveform comprises:

updating a current palette with the first index and the first waveform;

determining that the updated current palette includes the first waveform that can be used to drive the first display pixel and the second display pixel; and copying the first waveform from the current palette to the waveform table.

15. The method of claim 8 comprising:

determining that a display controller has used the first waveform to drive the first display pixel to the first desired color; and removing the first waveform from the waveform table.

16. The method of claim 8 wherein stabilizing the first frame buffer pixel comprises:

updating the first frame buffer pixel with an initialized index that is associated with a null waveform comprising zero volt charges.

17. A computer program product comprising a non-transitory computer usable medium including a computer readable program, wherein the computer readable program when executed on a computer causes the computer to:

receive a first desired color for a first display pixel;

determine a first waveform to drive the first display pixel to the first desired color;

update a first frame buffer pixel in a frame buffer corresponding to the first display pixel with a first index associated with the first waveform;

update a waveform table with the first waveform after updating the first frame buffer pixel;

receive a second desired color for the first display pixel to interrupt the driving of the first display pixel to the first desired color based on determining that the first display pixel is not stabilized;

create a second waveform to drive the first display pixel to the second desired color whose length and sign are determined by adding a first net voltage remaining in the first waveform plus a second net voltage used to drive the first display pixel from a current color to which the first pixel is being driven to the second desired color;

receive a third desired color for a second display pixel while the driving of the first display pixel is incomplete;

determine a third waveform to drive the second display pixel to the third desired color;

apply the interrupted first waveform and the second waveform to the first display pixel and apply the third waveform to the second display pixel concurrently;

determine that a current frame of a current cycle in the waveform table is later than a completion cycle and frame for the first frame buffer pixel;

stabilize the first frame buffer pixel; and return the first index to an index repository.

18. The computer program product of claim 17, wherein determining the first waveform to drive the first display pixel comprises retrieving the first waveform from a waveform library that includes pre-determined waveforms to drive display pixels from one color to another color.

19. The computer program product of claim 17, wherein determining the first waveform to drive the first display pixel comprises computing the first waveform.

20. The computer program product of claim 17, wherein the first index associated with the first waveform is retrieved from the index repository that includes a pool of available indices available to be associated with various waveforms.

* * * * *